United States Patent [19]

Hansen et al.

[11] 4,373,710

[45] Feb. 15, 1983

[54] APPARATUS FOR INSERTING SUPPLEMENTARY MATERIAL INTO NEWSPAPER JACKETS

[75] Inventors: Kenneth H. Hansen, Littleton; Louis S. Conover, Jr., Aurora, both of Colo.

[73] Assignee: Nolan Systems, Inc., Denver, Colo.

[21] Appl. No.: 180,368

[22] Filed: Aug. 22, 1980

[51] Int. Cl.[3] ..... B65H 5/30

[52] U.S. Cl. ..... 270/55; 198/644; 271/243; 271/261; 271/303

[58] Field of Search ..... 270/54–58; 271/243–245, 272–274, 261, 259, 227, 303, 260; 198/836, 644, 656

[56] References Cited

U.S. PATENT DOCUMENTS

| | | | |
|---|---|---|---|
| 2,540,972 | 2/1951 | Wagner | 271/303 X |
| 2,979,331 | 4/1961 | Backhouse | 271/243 X |
| 3,260,516 | 7/1966 | Blair | 270/57 |
| 3,517,919 | 6/1970 | Flygare | 493/419 X |
| 3,711,083 | 1/1973 | Cantrell | 270/55 |
| 3,825,246 | 7/1974 | Elia | 270/58 |
| 3,877,692 | 4/1975 | Kluge | 270/55 |
| 3,953,018 | 4/1976 | Maopolski | 270/55 |
| 4,046,367 | 9/1977 | Merker | 270/55 |
| 4,133,521 | 1/1979 | Muller | 270/55 |
| 4,168,828 | 9/1979 | McLear | 270/58 X |
| 4,201,378 | 5/1980 | Hams | 271/261 |

*Primary Examiner*—A. J. Heinz
*Attorney, Agent, or Firm*—Gary M. Polumbus

[57] ABSTRACT

A method and apparatus for high-speed in-line or off-line insertion of newspaper supplements and the like into newspaper jackets is disclosed. In in-line insertion, the jackets are indexed and transported through a sensing station where a diverting conveyor takes any jacket that is sensed to be out of position relative to an assembly conveyor carrying pockets. Each pocket receives a jacket and has a fixed side which precedes a pivotal side in the path of travel. The fixed side and the pivotal side are spaced apart at the bottom of the pocket. Adjustable support bars run continuously underneath the pockets bridging the space between pocket sides and support the jacket and insert. The pockets mechanically spread the jackets as the pockets travel downstream, where an insert feeder impels the bottom insert of a stack of inserts into the open pocket. The initial feeding of a jacket, and later feeding of the insert, are sensed photoelectrically. Failure to feed a jacket causes the insert feeder not to deliver an insert into the empty pocket. Failure to feed an insert into a pocket containing a jacket causes a latching mechanism on the pocket to engage and prevent release of the defective product to a discharge conveyor. Any defective product is carried beyond the discharge point to a reject chute. Off-line insertion feeds jackets into the pockets of the assembly conveyor from the first of a series of insert feeders.

9 Claims, 22 Drawing Figures

APPARATUS FOR INSERTING SUPPLEMENTARY MATERIAL INTO NEWSPAPER JACKETS

BACKGROUND OF THE INVENTION

1. Field of Invention

This invention relates to newspaper inserters compatible with high-speed newspaper presses and more particularly to newspaper inserters of the type utilizing a vacuum type insert feeder to supply inserts to pockets mounted on an assembly conveyor previously supplied with newspaper jackets.

2. Brief Description of the Prior Art

The newspaper inserter of the present invention is of the general type disclosed in the patents to Merker et al, U.S. Pat. No. 3,926,423; Merker et al, U.S. Pat. No. 3,988,016; and Merker et al, U.S. Pat. No. 4,046,367.

U.S. Pat. No. 3,988,016 describes an insert feeder adapted to propel inserts into an assembly conveyor carrying V-shaped cross sectional pockets. The pockets receive newspaper jackets in-line, that is directly from a press, and mechanically spread the jackets for receipt of an insert from an insert feeder located at a position vertically above the assembly conveyor. The insert feeder mechanism utilizes a vacuum applied to the bottom insert, of several inserts stacked in a hopper, through a plurality of sucker arms to pull the bottom insert in the stack down to a position where it is nipped by a pair of small driven rollers. The sucker arms pivot below and behind the line of feed and must wait to return to its pick-up position until such time as the insert has cleared the rollers. In this configuration only 25% of the cycle time is actually spent driving an insert in the insert feeder. This limitation in turn dictates that the nipping rollers rotate at a very high speed of over 6000 r.p.m. to achieve an insert feeding output sufficient to match press speeds, approximately 40,000 issues per hour. To achieve these very high rotational speeds, the inserter must be built to very high specifications, resulting in a high cost.

Inherent problems arise from the use of high rotational speeds, which make compound operational problems which result in the use of any newspaper inserter. Two driven rollers leaves a very narrow choice to the user of the insert feeder as to just what thickness of insert can be handled because both rollers must be either set in fixed position, without provision for variation, or a complex mechanism used to allow variable spacing between the driven rollers. Two driven rollers also complicates gearing, lubrication and space requirements for the insert feeder.

Other prior art devices also use sucker arms in a similar manner, for example as shown in U.S. Pat. No. 3,966,186 issued June 29, 1976 to Helm. However, as in the art already discussed, the sucker arm must wait to return to its pick-up position until after the insert is driven through the nipping rollers. This results in an inefficient use of cycle time in an application where speed is the critical requirement.

The U.S. Pat. No. 4,046,367 patent discloses a newspaper inserter for feeding jackets in-line from a high-speed press to an assembly conveyor bearing V-shaped cross sectional pockets which receive the jackets from the press. The jackets are mechanically spread and held open to receive an insert from an insert feeder of the type disclosed in U.S. Pat. No. 3,988,016 discussed above. The insert feeder is disposed above the assembly conveyor transporting the pockets. The pockets consist of a fixed side and a pivotable side and are spaced apart at the bottom, while a belt conveyor is synchronized to travel underneath the pocket and support the assembled product. The product, jacket and enclosed insert, is automatically discharged, when the belt conveyor ends at a preselected position, onto a discharge conveyor. The discharge conveyor conveys the product underneath the superimposed assembly conveyor, to a horizontal discharge conveyor, which moves the product at a right angle away from the assembly conveyor to a remote locale for further handling. No specific provision is made for sensing success or failure of any of the steps of the method disclosed. Specifically, no provision is made for sensing any misaligned jackets coming from the press, missed delivery of jackets to the pockets, or missed delivery of an insert.

Misalignment of a jacket as it is conveyed from the press to the pockets along the assembly conveyor can cause a jam if the jacket, as ultimately fed, misses the pocket to which it is assigned by an indexing conveyor. The failure to feed a jacket to a specific pocket is not as critical. However, in efficiently using the insert feeder, it is desirable to not waste an insert on an empty pocket. The failure to feed an insert, also is not operationally critical, but results in a defective product which can be readily made acceptable if it is specially handled and separated from the others.

The art cited above does disclose direct or in-line feeding of a newspaper jacket from a press to a newspaper inserter machine. No specific teaching of these patents discloses the mechanism by which a lapped stream of newspaper jackets from a high-speed press can be unlapped and indexed for proper timed feeding to the V-shaped cross sectional pockets mounted on the assembly conveyor. Off-line feeding and stacking jackets from the press for later assembly, is not shown for the newspaper inserter of U.S. Pat. No. 4,046,367. Other methods use exclusively off-line assembly, but make no provision for in-line assembly.

Forming a single lapped stream from two different newspaper streams, utilizing indexing pins along a belt conveyor is shown in U.S. Pat. No. 3,874,649 issued Apr. 1, 1975 to Bryson et al. Application of that system to a lapped stream coming from a press for ultimate timed feeding to the assembly conveyor of the present invention is not known. Neither adequate means for sensing jacket location for proper alignment while being indexed, nor means for diverting any misaligned jackets are shown in such an arrangement. Failure to protect the machine from a misaligned jacket can be critical in terms of the potential for a jam, if the jacket is delivered out of synchronization with the assembly conveyor.

The V-shaped pockets of the prior art have found wide acceptance in various newspaper inserter and newspaper handling devices. Gravity discharge, of the jacket and enclosed newspaper insert, has been slowed by frictional forces when utilizing the pocket configuration and articulation as previously known. The quickest possible discharge of the product to the discharge conveyor is essential in achieving high operational speeds, as well as in avoiding serious jams and lost time in trouble-shooting that should be spent in production.

Part of the problem associated with pocket configurations of the prior art arises from the fact that inserts are fed to the pockets in a direction opposite that of the line of travel of the assembly conveyor. Because of the combination of the high speeds of the assembly conveyor and the oppositely moving insert, pocket configurations of the past have had to reduce the impact forces where possible in order to minimize the chance of a misaligned insert feed. This has been done by slanting the pocket side which is impacted by the insert, with corresponding increased frictional forces to contend with on discharge.

Another difficulty presented by the prior art is that mechanically spreading the newspaper jackets depends upon an off-fold (the extent that one half of the jacket extends beyond the other half) of the jacket being within a specified range. The off-fold, or extended half, is clamped by appropriate gripping hook mechanisms located on the uppermost portion of the pocket, and the jacket is mechanically spread for receipt of an insert. This mechanical gripping, coupled with the fact that press cut-offs can vary up to three inches, requires that the height of the gripping hooks above the assembly conveyor must be altered for each pocket when a new dimension of cut-offs is used. Manual adjustment of the distance between the synchronous belt supporting the bottom of the newspaper jacket and the gripping hook mechanism is time consuming when it is realized that all pockets must be individually adjusted.

The particular characteristics of the insert feeder of the present invention make it desirable for small stacks of inserts to be fed to a hopper of the insert feeder so that the forces transmitted to the bottom insert of the stack held in the hopper are minimized. This is best accomplished by automatically and sequentially feeding lightweight stacks of inserts to the hopper. A further advantage of conveying pre-stacked inserts to the insert feeder is the automation of the entire newspaper inserter system to the maximum extent possible. An example of an apparatus for advancing bundles to a hopper of a newspaper handling machine and then stripping the bundles from the conveyor and dropping them from a relatively high position into a hopper is shown in U.S. Pat. No. 4,046,370 issued Sept. 6, 1977 to Navi. The dropping of relatively heavy bundles of inserts from high positions above the hopper transmits excessive forces. These forces transmitted through the insert stack can cause the separation of several inserts for pick-up by the sucker arms, rather than single inserts necessary for the system to operate.

OBJECTS AND SUMMARY OF THE INVENTION

The principal object of the present invention is to provide a high-speed in-line or off-line insert feeder for newspaper supplements compatible with high speed newspaper presses.

A related object of the present invention is to provide an apparatus for insert feeding which is adaptable to many thicknesses of inserts.

A further related object of the present invention is to increase the percentage of the cycle time in which inserts are being driven through an insert feeder so as to match press speeds while maintaining practical rotational speeds in the insert feeder.

Another related object of the present invention is to provide an insert feeder apparatus which reduces the number of driven rollers in an insert feeder.

Another object of the present invention is to provide apparatus for improved discharge of a combined newspaper jacket and enclosed insert product from a newspaper inserting device to a discharge conveyor.

A related object of the present invention is to provide apparatus which handles the variation in dimension of newspaper cut-offs without extensive manual change-over of pockets carried by an assembly conveyor.

Still another object of the present invention is to provide apparatus to properly align and sychronize newspaper jackets for feeding into a newspaper inserter itself and to divert away any misaligned jacket.

A related object of the present invention is to provide a method and apparatus to sense a missed jacket being delivered to the assembly conveyor of a newspaper inserter, track the pocket location that would have received the missed jacket and avoid feeding the insert that would have fed into that pocket location.

A further related object of the present invention is to provide a method and apparatus to sense the feed of an insert from an insert feeder into an assembly conveyor pocket and move any jacket without an insert to a preselected reject position.

In accordance with the objects of the invention a conventional newspaper press produces folded newspaper jackets which are conveyed away from the press by a newspaper conveyor. The newspaper jackets, when they reach the newspaper conveyor, are prefolded with an extended or top half over a bottom half, the top half being slightly longer than the bottom half producing an off-fold condition.

The off-folded newspaper jacket is conveyed from the press, folded end first, to a speed-up conveyor, where it is accelerated. An indexing conveyor receives the accelerated jacket, fold first, and synchronizes the movement of the newspaper jacket with an assembly conveyor with pockets mounted on it, which pockets will ultimately receive the folded jacket.

While being indexed, the folded jacket is sensed for proper position and length. Any misaligned or unusually dimensioned jacket is removed by a diverter conveyor which removes the jacket from the newspaper inserter.

Any jacket that is not diverted is fed downward and forward to the plurality of pockets moving in a closed loop on the assembly conveyor. As the jackets are dropped into adjacent pockets they are again sensed. Any empty pockets, not receiving a jacket, are tracked to the position where the newspaper inserts are fed by an insert feeder. The pocket without a jacket is skipped by the insert feeder.

Each pocket is open at the bottom and has a fixed side and a pivotal side being spaced apart at the bottom. The folded end of the jacket rests upon a pair of stationary, smooth metal support rods running longitudinally below the pockets of the assembly conveyor. Once a jacket has been deposited in a pocket travelling on the assembly conveyor the rearward or pivoting side of the pocket pivots forwardly toward the fixed side of the pocket. Gripping hooks, rotatably mounted along the top edge of the pivotal side, rotate to clamp the bottom half of the jacket and displace the top half of the newspaper jacket away from the pivoting side to a position to be clamped by a second set of gripping hooks disposed upon the top of the fixed side. Once the top half of the newspaper jacket has been grasped by the gripping hooks, the pivoting side of the pocket pivots to an open position to place the pocket into a position for receipt of an insert.

The insert feeder forwardly and downwardly propels an insert into an open pocket at a positive relative velocity to that of the assembly conveyor. The feeding or failure to feed an insert at the insert position is also sensed. A latching mechanism automatically closes the opening between pocket sides of any pocket, which is determined not to have an insert, and passes that pocket beyond the normal discharge position to a reject position. The latching mechanism is opened before reaching the reject position and the defective product deposited on a reject conveyor.

Products containing a jacket and enclosed insert are conveyed past the insert feeder. The pivotal side of the pocket is pivoted to a position where the pivotal side and the product are in a vertical position. These products are allowed to drop from the pocket, when the support rods terminate, onto a discharge conveyor.

The foregoing description relates to in-line insertion of newspaper inserts into newspaper jackets. In-line insertion relates to direct feeding of the newspaper jacket from the press into the newspaper inserting device. In off-line insertion, one insert feeder, there can be several depending on the number of inserts needed, of the newspaper inserter can be adapted to feed newspaper jackets instead of inserts. Other than the conveyance system from the press to the newspaper inserter itself, the structure is the same in virtually all respects for off-line insertion.

The plurality of pockets mounted to the conveyor are connected to a mounting block having two end portions supporting rollers. A frame for the newspaper inserter supports a track on which ride the rollers mounted to the end portions of the mounting blocks. Relatively short pins extending outwardly from a chain engage the rollers of the assembly conveyor, which chain pulls the pockets along as the chain moves.

The mounting block end portions are spaced apart over the pair of adjustable support rods which support the jacket between the sides of the pocket. The support rods are capable of moving up or down relative to the fixed position of the pocket and its mounting block. Though they are stationary during operation, the height of the support rods relative to the pocket sides can be varied to allow for various sized jackets.

The pivotal side of each pocket has a trailing cam follower lever disposed underneath and rearward of the pocket. A cam roller is disposed at the end of the lever to engage in sequence two cam bars mounted to the frame underneath the pockets. The cam bars move the pivotal side up for purposes of first spreading the newspaper jacket and later discharging the completed product. An additional retractable cam bar is necessary so that in-line or off-line feeding of the jacket may be chosen. In off-line insertion, the first insert feeder delivers the jacket. The jacket is then spread before reaching the second insert feeder, which holds the inserts. This additional cam bar will be located between the first and second insert feeders on the newspaper inserter. In-line insertion must spread the jacket before the first insert feeder is reached, so the cam bar is positioned before the first insert feeder.

During the step of upwardly pivoting the pivotal side of the pocket, the gripping hooks attached to the top of the pivotal side are activated by a trigger arm affixed to the frame of the newspaper inserter. The trigger arm activates a trigger finger at the edge of the pivotal side which turns an axle integrally mounting the gripping hooks. The off-fold of the jacket is thereby raised by the gripper hooks of the pivotal side which gripper hooks clamp the bottom half of the jacket. As the pivotal side moves to vertical, similar trigger fingers on the fixed side are turned to rotate the gripping hooks on the fixed side of the pocket to clamp the top half of the jacket. The pivotal side is then downwardly pivoted by the same camming action between the cam roller and cam bars and the pocket and spread open jacket are ready for receipt of an insert.

Prior to discharge of the product the pivotal side of the pocket is upwardly pivoted again and a second set of trigger arms fixed to the frame of the newspaper inserter contact the other end of the trigger fingers simultaneously causing both sets of gripping hooks to rotate back to their initial positions and allowing the product to drop between the pocket sides as the support bars end.

A discharge drum receives the product from the assembly conveyor and laps it onto the discharge conveyor, which is superimposed by the assembly conveyor. The discharge conveyor moves the lapped product in the reverse direction of the assembly conveyor to a horizontal conveyor, which removes the entire product at a right angle away from the assembly conveyor to a remote location for further handling.

The insert feeder feeds inserts, from a stacked position in a hopper, into the assembly conveyor pockets. Pneumatically operated fingers support the front or folded edge of the insert stack. A plurality of sucker arms are moved to a position engaging the downstream end of the insert. A relatively large driven roller is located immediately below and slightly toward the upstream end of the insert. A smaller second set of idler rollers move from a position below the driven rollers to a position upon the driven roller where an insert can be nipped. As the sucker arm is moved downward, a set of push levers engage the end of the insert nearest the downstream end of the assembly conveyor and feed the insert between the driven roller and idler roller. As the lever moves downward the sucker arms move back away from the hopper and away from the push levers to a position clear of the insert. While the insert is being driven between the driven roller and idler roller past a guide and downward into the pocket, the sucker arms move back into position to engage the next insert.

DESCRIPTION OF THE PREFERRED EMBODIMENT

Introduction

Figure 1:
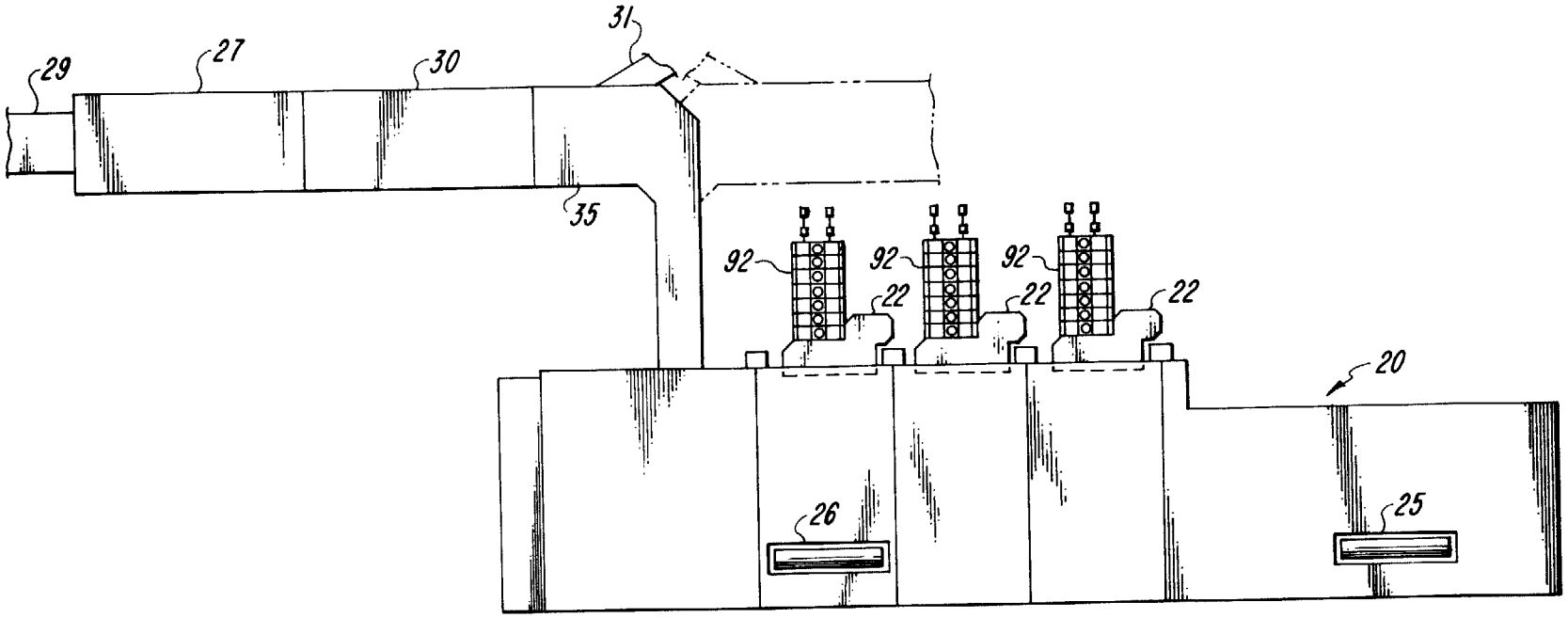
FIG. 1 is a schematic view of the present invention showing the various integrated parts.
Figure 2:
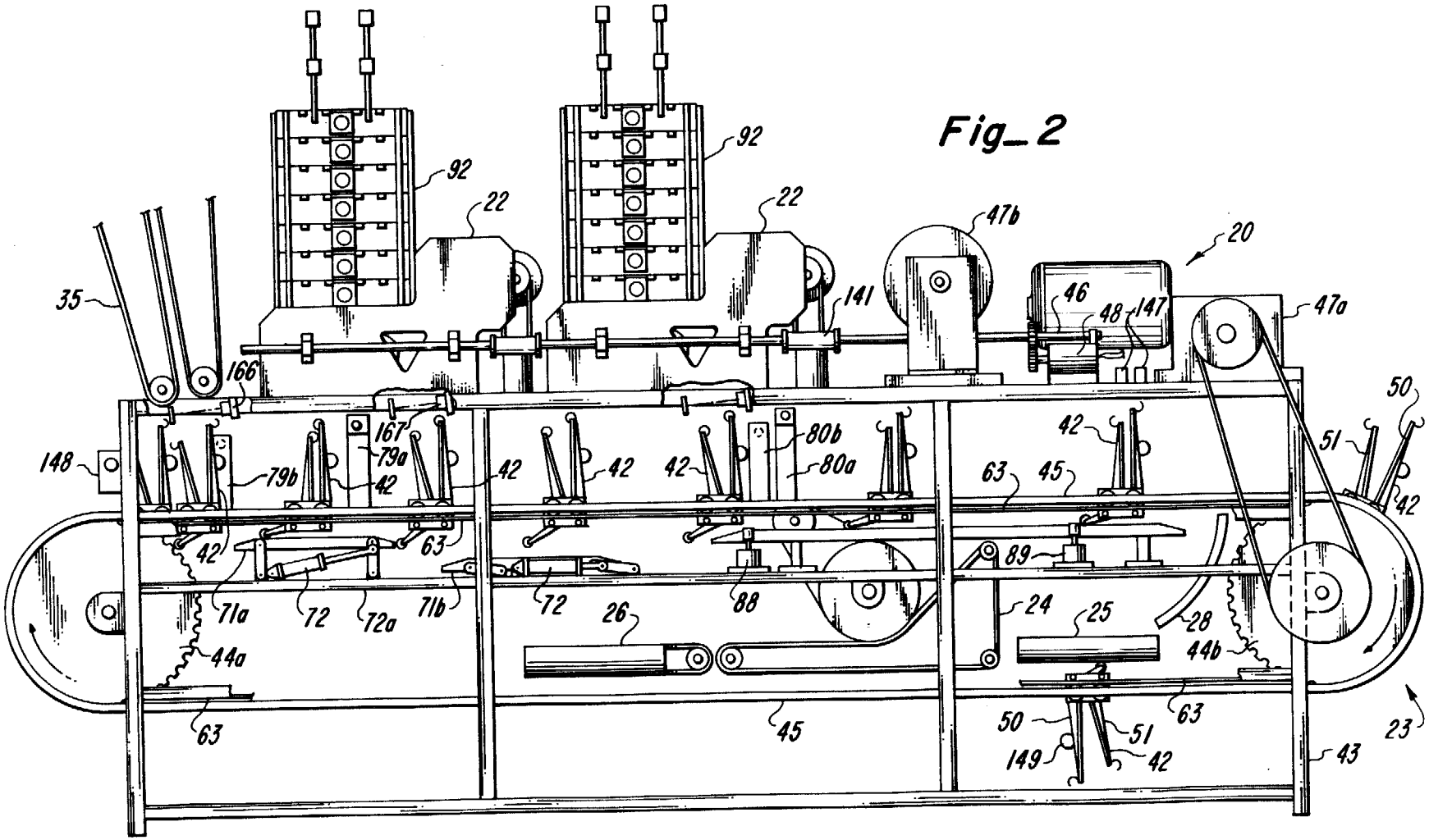
FIG. 2 is a diagrammatic side elevation of the insert feeder mounted on the newspaper inserter with a fragmentary view of the feed conveyor.

A newspaper inserter 20, shown in FIGS. 1 and 2, receives newspaper jackets from a press (not shown) having an output of up to 40,000 issues per hour. The newspaper inserter takes the newspaper jackets from the press in a folded condition and delivers newspaper inserts or supplements, consisting of advertising materials, feature magazines or the like, into the newspaper jacket. The newspaper jacket and enclosed insert, forming a completed product, are taken to a remote location for further handling.

The jacket is received directly from the press by the newspaper inserter 20 in an in-line insertion. The newspaper inserter 20 can also be utilized to feed the inserts into the jackets when the jackets are not coming directly from the press but are off-line. In off-line insertion, the jackets, preferably thin newspapers or comic sections, are stored in the first of a series of insert feeders 22, (FIGS. 9 and 10) which form a part of the newspaper inserter 20. The insert feeders 22 are positioned vertically above an assembly conveyor 23 (FIG. 2) which receives the jackets, either directly from the press or from the first insert feeder 22, and moves the jackets along a path below the insert feeders 22.

Figure 18:
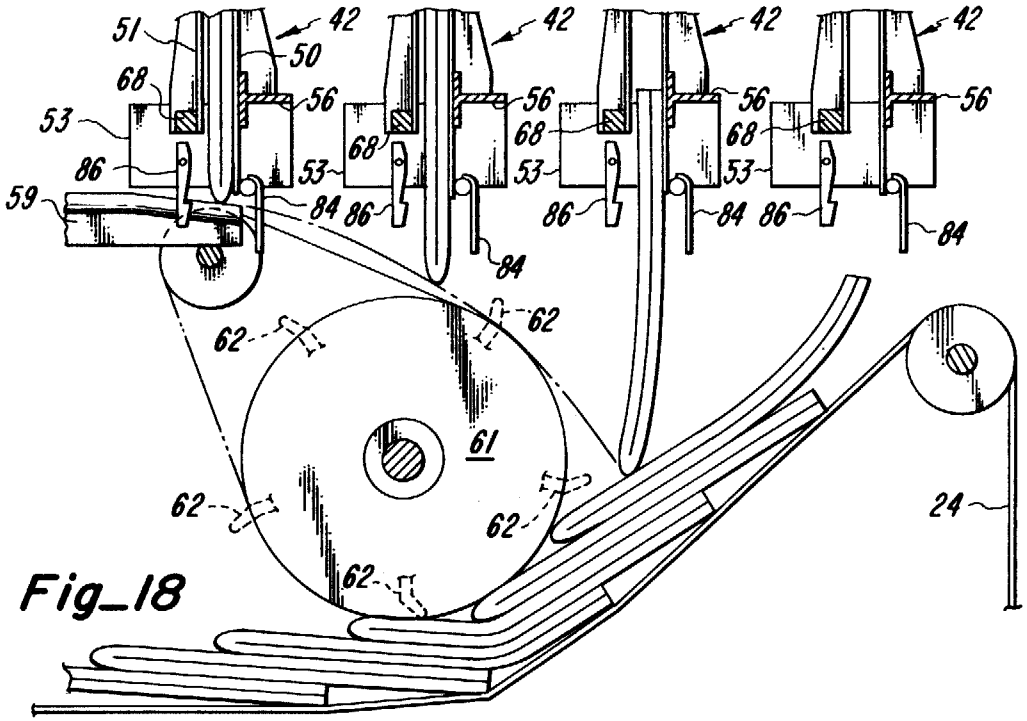
FIG. 18 is a diagrammatic vertical section illustrating the removal of completed products from the newspaper inserter and deposition of these products onto the discharge conveyor.

In either in-line or off-line insertion, one of the insert feeders 22 delivers inserts to the assembly belt conveyor 23 as it moves beneath the insert feeder 22. Any number of inserts can be fed into a jacket, but for purposes of this disclosure it will be assumed that two inserts, and therefore two insert feeders, are required for an in-line operation shown in FIG. 2. After receiving the inserts, the completed product is moved by the assembly conveyor 23 to a preselected position where the assembly conveyor 23 utilizes the force of gravity to drop the completed product onto a discharge belt conveyor 24 (FIGS. 2 and 18). The discharge conveyor 24 is vertically adjacent and below the assembly conveyor 23. The discharge conveyor 24 preferably moves in a direction opposite the path of the assembly conveyor 23 so that a minimum of space is utilized. The completed product is taken from the discharge conveyor 24 by a horizontal belt conveyor 26 (FIG. 2) moving at right angles away from the newspaper inserter 20.

The newspaper inserter 20 senses the feeding of both the jacket and the insert. If a jacket is not fed, the insert feeder 22 does not impell an insert into the location on the assembly conveyor 23 where that jacket would have been as it passed underneath the insert feeder 22. If an insert is not fed into the jacket, the assembly conveyor 23 does not drop the defective product, absent an insert, onto the discharge conveyor 24. The defective product is instead carried further downstream from the discharge conveyor 24 to a reject chute 28 (FIG. 2), which receives the defective product from the assembly conveyor 23. Like the discharge conveyor 24, the reject chute 28 is vertically adjacent and below the assembly conveyor 23. The force of gravity delivers the defective product from the assembly conveyor onto a reject belt conveyor 25, which moves the product at right angles away from the newspaper inserter 20, as seen in FIGS. 1 and 2.

In-Line Insertion

In in-line insertion the newspaper inserter 20 receives previously folded newspapers from the conventional newspaper press. The jackets move along a newspaper conveyor 29 (FIG. 1) with the folded edge first. Throughout the newspaper jacket handling associated with the present invention, the folded newspaper jacket is maintained in an off-fold position. In the off-fold position each sheet of the newspaper jacket is folded at least twice, the major fold dividing the newspaper jacket into an extended or top half and a relatively short bottom half and a minor fold perpendicular to the major fold. The difference between the length of the extended half and the relatively short half creates an off-fold along the edge of the folded newspaper jacket opposite the major fold. While the newspaper jacket is conveyed through the newspaper inserter 20 the extended half is on top of the relatively short half. In a conventional manner the newspapers are transported in a lapped relationship along the newspaper conveyor 29 between spring wire belts which are not specifically illustrated.

From the newspaper conveyor 29 the folded newspaper jacket is moved to a speed-up conveyor 27, which takes the folded newspaper jackets from a lapped stream, which is the normal manner in which the jackets come from the press, and separates them. From the speed-up conveyor 27 the jackets enter the indexing conveyor 30, seen in FIGS. 3 and 4, which begins the process of synchronizing the movement of the newspaper jackets with the movement of the assembly conveyor 23 of the newspaper inserter 20. While the jackets are moving along the indexing conveyor 30, they are sensed for abnormalities, including overlength jackets and improperly indexed jackets. Any jacket that is not properly aligned when sensed is removed from the indexing conveyor 30 to a diverter conveyor 31. The diverter conveyor 31 is superimposed at a position vertically adjacent to and above the indexing conveyor 30. The feed conveyor 35 takes jackets from the indexing conveyor 30 and delivers them directly onto the assembly conveyor 23 of the newspaper inserter 20.

The speed-up conveyor 27 receives the lapped newspaper jackets from the newspaper conveyor 29 and separates them in a conventional manner to approximately a four inch gap between successive newspaper jackets. The speed-up conveyor 27 consists of a series of driven rollers each set running at a faster speed than the preceding set, as partially seen in FIGS. 3 and 4. This art is well known to the newspaper industry. The rollers of the speed-up conveyor 27 are pivotably mounted and spring loaded to compensate for varying newspaper jacket thickness.

Figure 3:
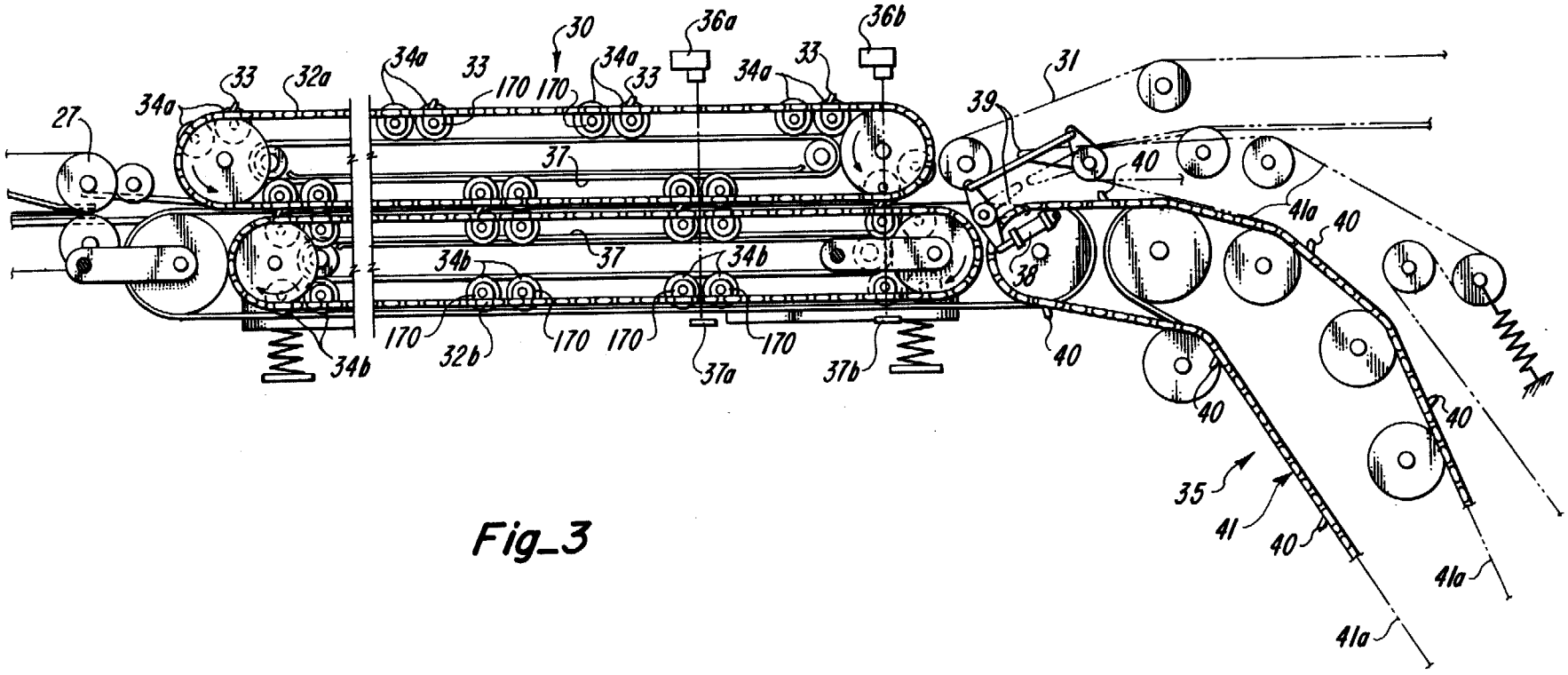
FIG. 3 is a diagrammatic side elevation of the indexing conveyor, with the speed-up conveyor and feed conveyor partially shown.
Figure 4:
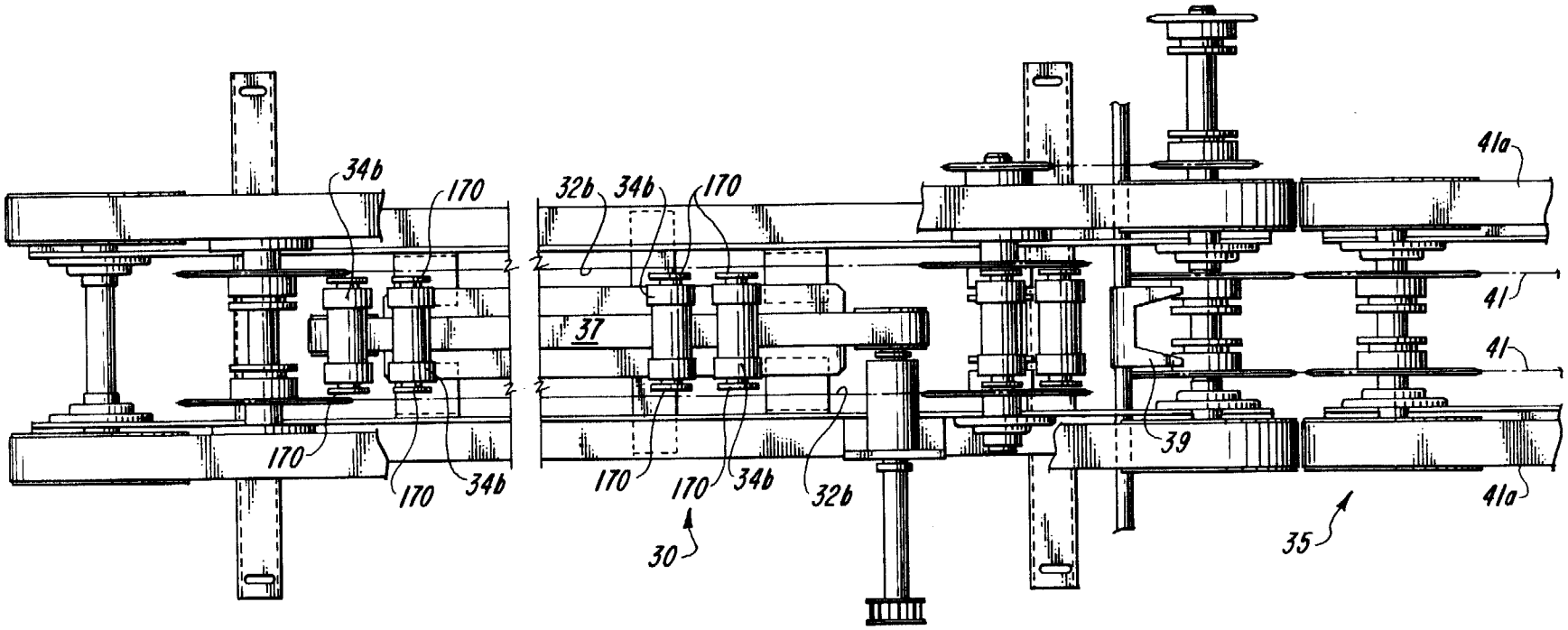
FIG. 4 is a top plan view of the indexing conveyor shown in FIG. 3, the upper timing belt removed for clarity.

From the speed-up conveyor 27, the jackets are received by the spring bias mounted indexing conveyor 30. The indexing conveyor 30 includes a pair of superimposed upper and lower timing roller chain assemblies 32*a* and 32*b*. Each roller chain assembly 32 includes two parallel assemblies running around pulleys spaced by an axle (FIG. 4), an open space being defined between the parallel chain assemblies. Indexing is a critical operation to synchronizing the relative positions of the newspaper jackets for ultimate delivery to the assembly conveyor 23. Both the speed-up conveyor 27 and the indexing conveyor 30 are best seen in FIG. 3. Proper and consistent positioning is insured by mounting a series of pivotal pins 33 on the upper roller chain assembly 32*a* against which pin the folded edge of the newspaper jacket is positioned. The pivotal pins are therefore preset to move in conjunction with the assembly conveyor 23.

The newspaper jackets enter the indexing conveyor 30 in random position relative to the pivotal pins 33. The jackets will be driven, within the indexing conveyor, at a speed higher than that of the timing roller chain assembly 32 of the indexing conveyor 30 until the jacket reaches a position behind one of the pivotal pins 33.

The jackets are driven forward within the indexing conveyor 30 by means of two sets of frictionally driven rollers 34*a* and 34*b* mounted on the upper and lower timing chains 32 in pairs, rollers 34*a* being upper rollers and rollers 34*b* being bottom rollers. The rollers 34*a* and 34*b* are rotatably mounted between extending portions of a generally U-shaped roller carrier 170 mounted on the timing chains 32. The rollers 34*a* or 34*b* are mounted in pairs, with a distance between pairs equal to the length of a newspaper jacket, so that the jacket will be forced against a pin by the rollers. The upper roller pair 34*a* is mounted so that the rollers are vertically adjacent and slightly downstream of an associated pin 33.

The rollers 34*a* and 34*b* are not driven until such time as a pair of moving friction belts 37, circumscribed by the timing chains 32, are contacted. The friction belts are single loops running in the open space between parallel timing chains 32 and at a preselected position between the loop defined by the timing chains 32. The distance between the two friction belts and the newspaper jackets, as they travel between the timing chains 32, corresponds generally to the diameter of the rollers 34*a* and 34*b* so that when the rollers 34*a* and 34*b* contact the friction surface, they also contact the newspaper jacket.

The friction belt 37 ideally travels in the same direction and at a speed less than that of the indexing conveyor 30. For example, if the friction surface 37 is stationary, the rollers 34*a* and 34*b* will rotate and drive the jackets at an accelerated speed relative to that of the timing chains 32 to which the rollers are mounted. If the friction surface is travelling at the same speed as the timing chain 32, no relative rotation of the rollers 34*a* and 34*b*, and therefore no acceleration will take place. Thus, by adjusting the speed of the friction belt relative to the speed of the timing chains, the rotational speed of the rollers 34*a* and 34*b* will be altered and the accelerating forces on the heavy jackets can be varied.

Longitudinally adjacent roller pairs 34*a*, or 34*b*, are linearly spaced, along the direction of travel, at a distance slightly greater than the length of the newspaper jackets. Once a jacket is moved against a pivotal pin 33, there is no longer any rollers 34*a* and 34*b* acting on the jacket due in part to the spacing, plus the fact that the roller pairs 34*a* and 34*b* are positioned just slightly downstream of the pivotal pins.

The pivotal pins 33 are pivotally mounted on the upper timing roller chain 32 because as a jacket enters the indexing conveyor 30 it will be driven forward to the furthest pivotal pin 33 by the frictionally driven rollers 34*a* and 34*b*. If the jacket arrives at the indexing conveyor 30 simultaneously with a pin 33, the pin must not interfere with this movement, and therefore is pivoted out of the way as it engages the jacket.

At the final downstream pivotal pin 33 position of the indexing conveyor 30 the jackets are sensed for proper alignment and position. Two photoelectric sensing stations 36*a* and 36*b* are mounted above the conveyor 30 and are horizontally displaced from each other approximately the length of a newspaper jacket. Each photoelectric sensing station 36*a* and 36*b* consists of a photoelectric light source or beam. Photoelectric cells 37*a* and 37*b* are vertically aligned with the stations beneath the conveyor 30 so as to receive the emitted beams. The photoelectric beam emission is timed to the passage of pivotal pins 33, so that as a pivotal pin 33 passes photoelectric sensing stations 36*a* and 36*b* are activated, as seen in FIG. 3.

A control circuit (not shown) receives the signal indicating whether or not the photoelectric beam of photoelectric sensing stations 36*a* or 36*b* has been broken. If the beam has been broken, the newspaper jacket at that position is misindexed or out of alignment. The control circuit associated with sensing stations 36*a* and 36*b* causes an actuator 38 to move a linked pair of fingers 39 located just past the final pivotal pin 33 position, which form a ramp from the indexing conveyor 30 to the diverting conveyor 31. The fingers are of identical configuration and are pivotably mounted transverse to the stream of movement of the indexing conveyor and diverter conveyor respectively. One finger angles upwardly from the line of movement of the indexing conveyor 30. The second finger 39 pivots downwardly from a diverter conveyor 31 to a position very near the end of the first finger 39. As the misaligned jacket reaches the fingers 39 it travels the ramp formed by the pair of fingers to the diverter conveyor 31. The jacket has enough momentum to move up the ramp and reach the diverter conveyor 31, which moves the jacket out of the assembly stream, as seen in FIG. 3.

From the indexing conveyor 30 the properly aligned jackets move onto a feed conveyor 35, which is kept at the same speed as the indexing conveyor by parallel chains 41 and flat timing belts 41*a* spaced laterally away from the timing belts 32*a*, 32*b* and the feed conveyor 35 (FIG. 3). The pivotal pins 33 of the indexing conveyor 30 are in synchronous relationship with indexing pins 40 on an indexing chain moving along the same path as the feed conveyor 35, as seen in FIG. 3. The indexing pins 40 receive the folded edge of the newspaper jacket from the pivotal pins 33 of the indexing conveyor 30, so that the jacket actually contacts the indexing pins 40. The feed conveyor 35 moves downwardly from the indexing conveyor 30, to a preselected delivery position over the assembly conveyor 23 from where the jacket can be driven downward into one of a plurality of V-shaped cross sectional pockets 42 or receptacles (FIGS. 2, 4, 5 and 6) carried by the assembly conveyor 23.

The Assembly Conveyor

The assembly conveyor 23 (FIG. 2) is mounted on a modular frame 43, which can be of the type described in U.S. Pat. No. 4,046,367. At each end of the modular frame 43 are a pair of concentric sprocket and roller drive assemblies 44*a* and 44*b* as seen in FIG. 2. Roller drive assembly 44*a* is transversely mounted across the frame 43 near the end of the assembly conveyor 23 which receives the jackets from the feed conveyor 35. Roller drive assembly 44*b* is transversely mounted across the frame 43 at the opposite end, just downstream and beyond the reject chute 28 briefly described previously. Hereinafter, downstream will indicate movement of the assembly conveyor pockets 42 from the feed conveyor 35 toward roller drive assembly 44*b*.

A pair of endless chains 45 mesh with and extend around roller drive assemblies 44*a* and 44*b*. The endless chains 45 move parallel to each other around the outside diameters of the roller drive assemblies 44*a* and 44*b* and along the distance between the two drive assemblies.

Figure 17:
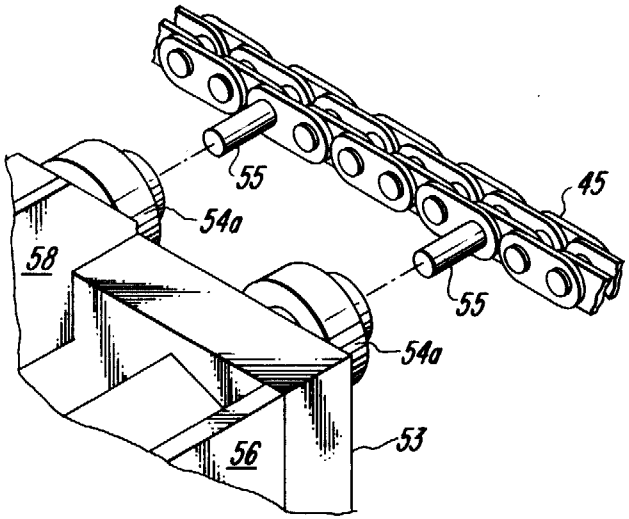
FIG. 17 is a fragmentary perspective view of the connection between rollers of a pocket and a main driven chain.

The pockets 42 are mounted on the endless chains 45 as seen in FIG. 17 and as will be described in more detail later. The pockets 42 are therefore located between the parallel endless chains 45 as they move around the roller drive assemblies 44*a* and 44*b*. As the pockets 42 are carried by the endless chain 45 under the feed conveyor 35 the pockets present their V-cross section upward to the feed conveyor 35. The pockets 42 present the same upward V-shape to each insert feeder 22 they pass under. The bottom of the pockets 42 passes over the discharge conveyor 24 and the reject chute 28 before moving around the outer circumference of roller drive assembly 44*b*. From roller drive assembly 44*b* to roller drive assembly 44*a*, the pockets 42 hang upside down, relative to the position in which the receive the jackets and inserts and travel around the outside circumference of the upstream roller drive assembly 44*a* and back to a position vertically adjacent and below the feed conveyor 35.

A drive motor 47*a* is mounted on the frame 43 above the roller drive assembly 44*b*. The drive motor 47*a* turns the roller drive assembly 44*b*, and associated endless chains 45, through conventional linkage (not shown). Another drive motor 47*b* operates the insert feeders 22 by turning a drive shaft 46 extending longitudinally along the upper portion of frame 43, where the insert feeders are mounted, as seen in FIG. 2. Both motors are controlled to drive at the same relative speed and the output shafts can be mechanically coupled to insure sychronization. For the in-line operation, the motors follow press speed by means of a tachometer generator output voltage, which is driven by the press and applied to the motor controller. For the off-line operation the motor controller is set manually to the desired speed.

Pocket Structure and Operation

The pockets 42 receive folded newspaper jackets, fold downward. Both unfolded edges of each newspaper jacket are clamped by gripping first the relatively short side of the jacket, then the off-fold edge of the extended side. The jacket is mechanically spread open to present a V-cross section upward, while the jacket is gripped at the edges in the pocket. The clamping, or gripping, and opening of the jacket takes place prior to the pockets 42 and gripped jackets reaching a location under an insert feeder 22. As the pockets reach the insert feeder, a newspaper insert is fed into the open pocket. The off-fold edges of the jacket are unclamped and the completed product is dropped onto the discharge conveyor 24 after the last insert feeder. Further provision is made for handling of a jacket into which an insert was not fed, as will be discussed hereinafter.

Figure 5:
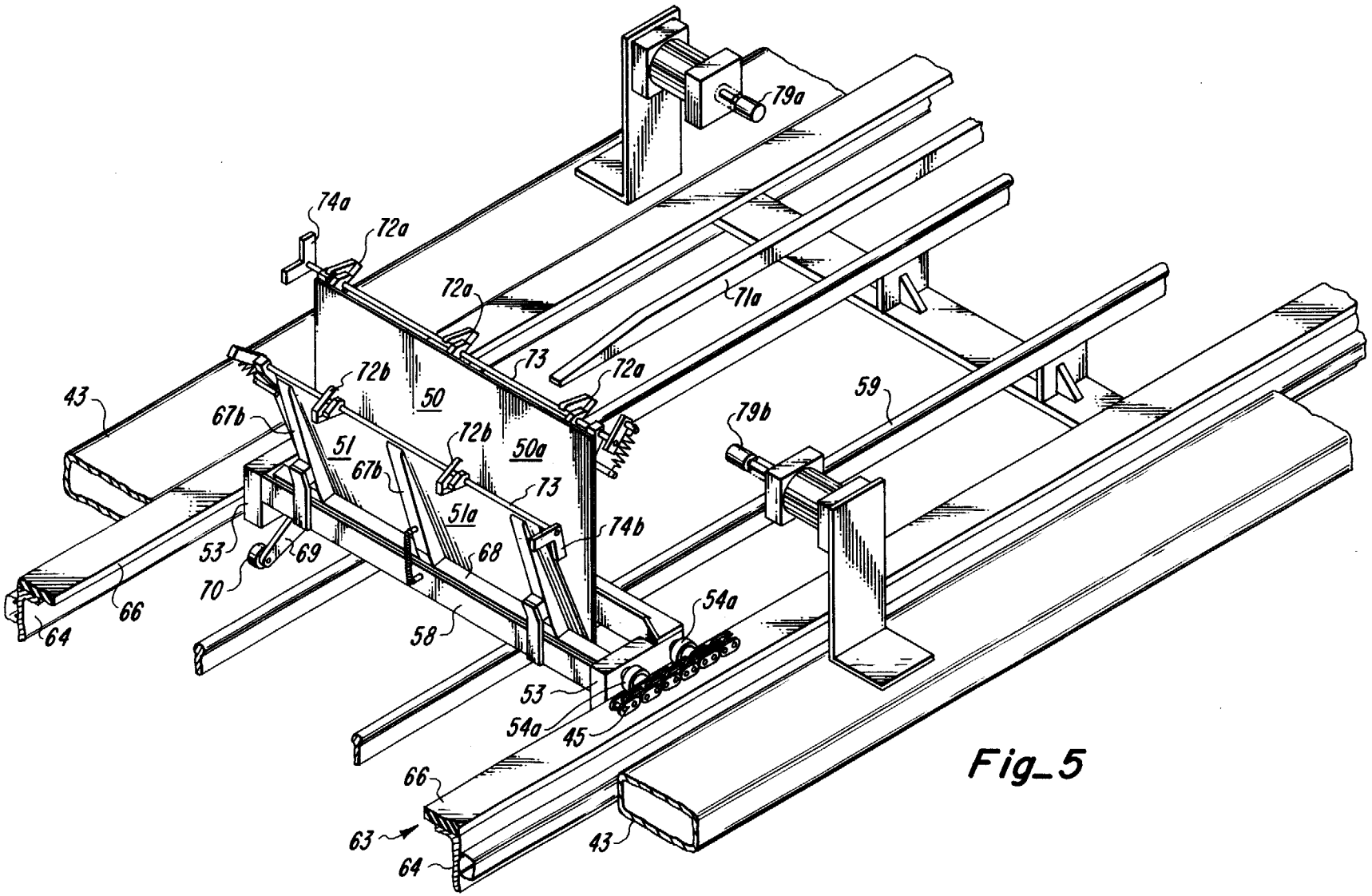
FIG. 5 is a fragmentary perspective view of the newspaper inserter particularly illustrating a newspaper pocket and a pair of support rods mounted on a frame of the newspaper inserter.
Figure 6:
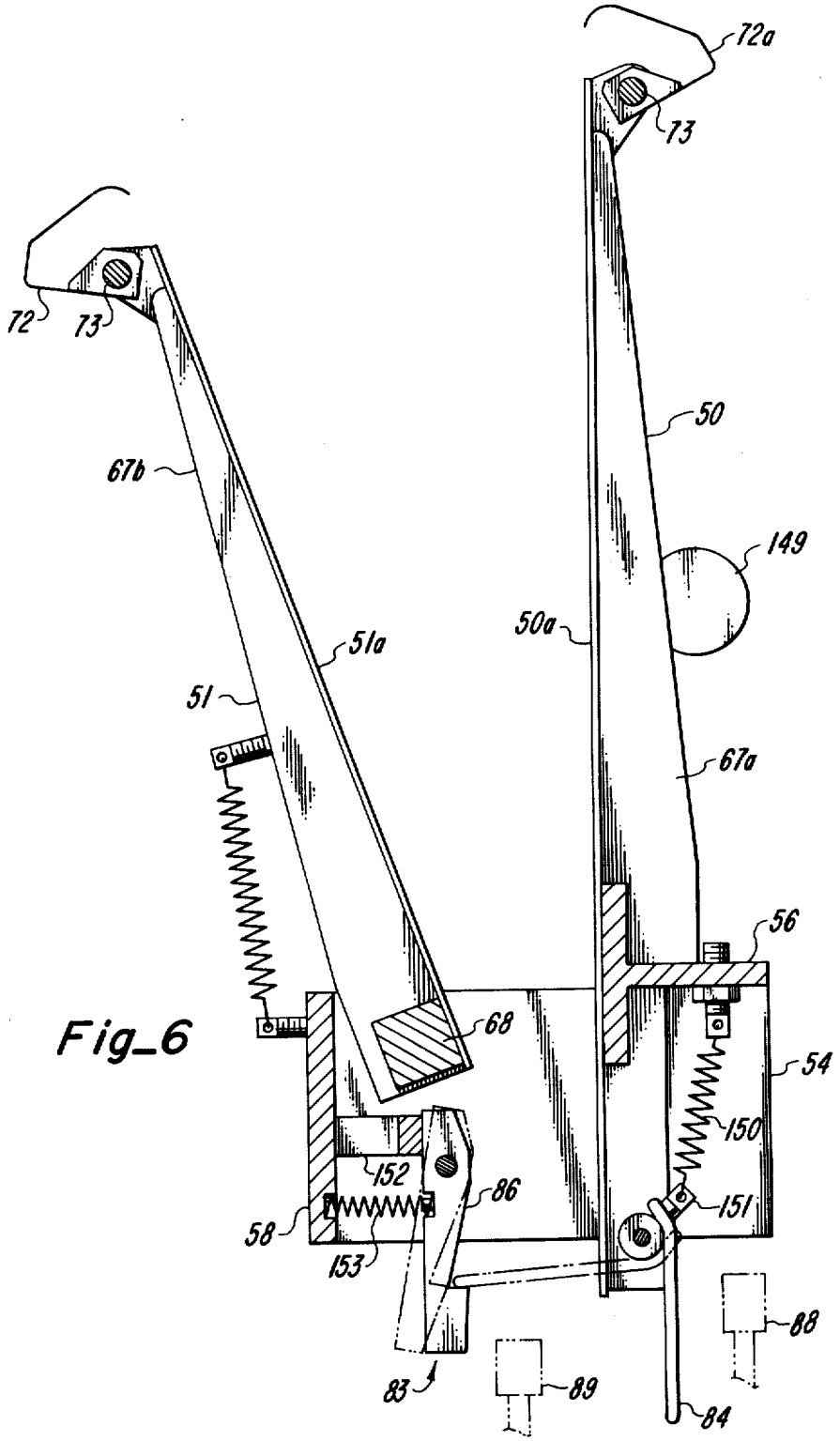
FIG. 6 is an enlarged vertical section taken along line 6—6 of FIG. 8.
Figure 7:
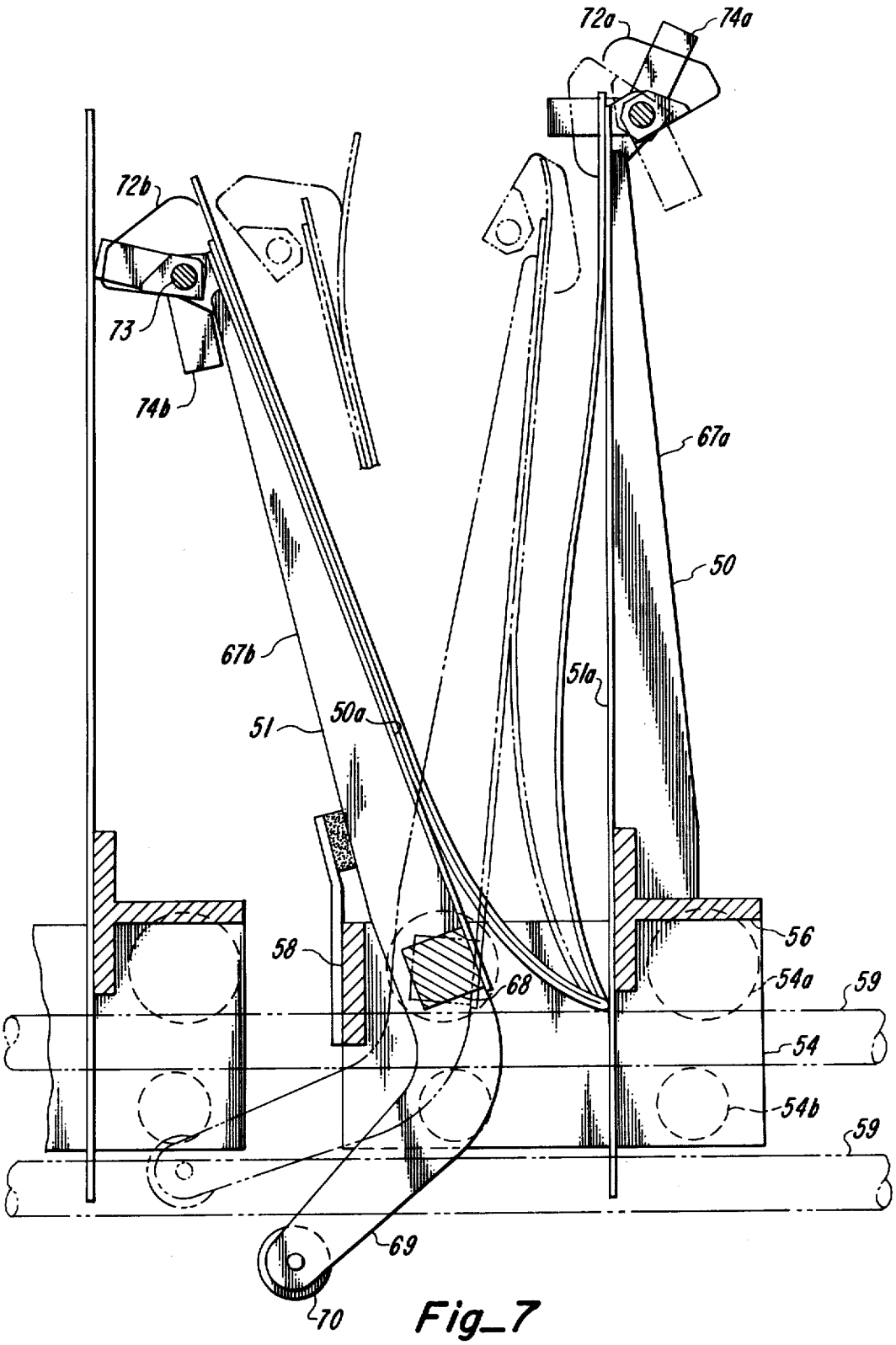
FIG. 7 is an enlarged vertical section taken along line 7—7 of FIG. 8.

Each of the pockets 42 (FIGS. 5, 6 and 7) includes a fixed side 50 which is on the leading side of the pocket 42 in the path of travel, and a pivotal side 51 which trails behind. Both sides are mounted transversely between rectangular end blocks or portions 53 of a mounting block 54. Projecting laterally away from each end portion 53 are two pair of superimposed rollers 54*a* and 54*b* journalled on shafts (not shown) which are spaced so that an upper pair of rollers 54*a* are mounted along a horizontal line near the top of the end portion 53 and a lower pair of rollers 54*b* are mounted along a horizontal line near the bottom of the end portion 53, as best seen in FIG. 7. The upper rollers 54*a* are adapted to be connected to the endless chain 45 by a pin connector 55, the pin extending from the chain 45 into the rollers 54*a*, as seen in FIG. 17. The end portions 53 of the mounting block 54 are held in a spaced relationship by a bar 56 of T-shaped cross section and a parallel rectangular cross sectional bar 58 (FIG. 6). The fixed side 50 of the pocket 42 is rigidly connected to the bar 56 as seen in FIG. 6. The rectangular bar 58 is rigidly mounted between the end portions 53 at a position slightly below the pivotal side 51. There is therefore defined between the bars 56 and 58 and the sides 50 and 51, an open space or pocket into which an unsupported jacket can fall between the end portions 53 and between the sides 50 and 51.

A pair of spaced, smooth metal support rods 59 are mounted on the frame 43 and run horizontally and continuously under the pockets 42. It is on these support rods 59 that the folded lower edge of a jacket rides so that even though the pivotal side 51 and the fixed side 50 are spaced apart, the jacket does not fall below the pocket 42 until the support rods 59 terminate at the discharge conveyor 24, best seen in FIG. 18.

The pockets 42 are moved by the endless chain 45 along a horizontal track 63 (FIG. 5), while being supported on both the top and bottom of the track by the rollers 54*a* and 54*b*. The pocket 42 is supported while it moves along the top of the assembly conveyor 23 by the upper rollers 54*a* and when the pockets, empty of any product, are moving upside down back to the position where a jacket will be fed, by the lower rollers 54*b*, as seen in FIG. 2. In the preferred embodiment the tracks 63 include a conventional angle iron bar 64 mounted on the inserter frame 43 in a conventional manner and a nylon bar 66 of rectangular transverse cross section. The nylon bar is supported by the angle iron horizontally and protrudes inwardly to provide upper and lower surfaces along which the rollers 54*a* and 54*b* of the pocket 42 can ride. The nylon bar 66 is particularly desirable in reducing noise levels associated with the newspaper inserter 20.

The fixed side 50 of the pocket 42 is supported by three vertical members 67*a* which are rigidly connected to the T-cross sectional bar 56. The vertical members 67*a* are connected to and covered by a planar sheet 50*a*, preferably of light-weight metal forming a smooth surface against which a jacket may ultimately lie.

The pivotal side 51 includes three vertical members 67b which are rigidly connected to each other by an axle 68 of square cross section which is rotatably connected to the end portions 53 of the mounting block 54. Vertical members 67b support planar sheet 51a of the same material as used in sheet 50a.

A cam lever arm 69 (FIGS. 5 and 7) extends downwardly and rearwardly from the square shaft 58 close to the end of the pocket. A cam roller 70 is rotatably mounted on the trailing end of the cam lever arm 69. The cam roller 70 is adapted to sequentially engage any one of the three cam bars 71a, 71b and 71c disposed along the length of the assembly conveyor 23 as seen in FIG. 2. Engagement of a cam bar by the roller 70 causes the pivotal side 51 to raise to a vertical position virtually parallel to the fixed side 50. The cam bars 71a, 71b and 71c are set at preselected positions between the sprockets 44a and 44b, near the path of the endless chain 45 as it moves the pockets 42 between the position where they are fed a jacket from the feed conveyor 35 and the position where the pockets 42 drop the completed jacket onto the discharge conveyor 24. The cam lever and roller must be offset to one side (see FIG. 8) because the cam bar will interfere with the drop of the papers.

Cam bars 71a and 71b are selectively movable between raised and lowered positions so as to either engage or not engage, respectively, the cam rollers 70. Air cylinders 72 (FIG. 2) are actuated to either raise or lower an associated cam bar through a conventional parallelogram linkage 72a.

The cam bars 71a and 71b are selectively movable in the newspaper inserter 20 to accommodate in-line or off-line operational modes. In the in-line mode of operation, shown in FIG. 2, the feed conveyor 35 delivers a jacket into an open pocket 42. The jacket must be spread open and the edges clamped into a configuration presenting a V-cross section upward, before the pocket reaches a position below the first insert feeder 22. Therefore, cam bar 71a, which is utilized in the raising of side 51 to open the jacket, is positioned in a raised position. In off-line operation, the first insert feeder 22 must feed a jacket, so cam bar 71a is lowered out of position and cam bar 71b is raised. Cam bar 71b is located between the first insert feeder 22 and the second insert feeder 22 so that the jacket is gripped at the edges and spread open for receipt of an insert between those two insert feeders 22.

The third fixed cam bar 71c raises the pivotal side 51 of the pocket 42 to a vertical position, generally parallel to fixed side 50, so that the completed product can be dropped between the open space defined between the pocket sides 50 and 51 and between the end portions 53 onto the discharge conveyor 24.

After the top off-fold edges are clamped, in a manner to be discussed shortly, the cam bars 71a and 71b lower the pivotal side, which leaves the jacket open, presenting a V-cross section upward for receipt of an insert. Both cam bars 71a and 71b raise pivotal side 51 through the movement of cam rollers 70 along the cam bars 71a or 71b, which raises cam lever 69 and pivots pivotal side 51. Cam bar 71c also raises pivotal side 51, at a position past the insert feeders 22 and above the discharge conveyor 24, so that the assembled product falls downward under the force of gravity onto the discharge conveyor 24, as seen in FIG. 18.

The actual clamping of the jacket is accomplished only in part by the pivotal side 51 being raised by either the cam bar 71a or 71b acting on cam roller 70 and cam lever 69. The newspaper jacket must be delivered into the pocket 42 in such a manner that the extended half of the jacket forms the top surface of the jacket laying in the pocket 42. The pivotal side 51 is in a lowered inclined position. This leaves the jacket in an off-fold condition, the extended half being above the shorter half, the shorter half lying on the planar sheet 51a of the pivotal side 51.

Gripping means are disposed across the top of both sides 50 and 51 of a pocket 42 to selectively grip opposite sides or edges of a newspaper jacket. Gripper hooks 72a are positioned across the top of the fixed side and identical gripper hooks 72b are positioned across the top of the pivotal side (FIGS. 5 and 7). The gripper hooks 72a and 72b extend upwardly from the sides 50 and 51 and then inwardly, toward the opposite side, 50 or 51. Typically the fixed side has three such gripper hooks 72a which are staggered relative to two such gripper hooks 72b on the pivotal side 51. The gripper hooks 72a and 72b for each side are fixed to a gripper hook axle 73 rotatably supported along the tops of the fixed side 50 and pivotal side 51 respectively. Both gripper hook axles 73 are connected to associate planar sheets 51a or 50a by a conventional over-center spring mechanism 60 which maintains the gripper hooks 72a and 72b in either a clamped or unclamped position relative to sides 50 and 51 of the pocket 42. Upon initial receipt of a newspaper jacket the gripper hooks 72a and 72b are in the unclamped position, shown in FIG. 5.

A pair of L-shaped trigger fingers 74a and 74b are fixedly connected to one end of each gripper hook axle 73 at a position laterally spaced from metal plates 51a and 50a. The trigger fingers 74a and 74b each have leg portions which extend a short distance above and below, respectively, the axis of the gripper hook axle 73 when the gripper hooks are in an open position. The trigger fingers 74a and 74b for the fixed side 50 and the pivotal side 51 respectively are at opposite ends of the associated axles 73.

A retractable trigger arm 79b, associated with the pivotal side 51, is mounted to frame 43 and extends into the path of travel of trigger finger 74b so as to contact the downwardly extending leg of the trigger finger. Prior to the pivotal side 51 being raised by cam bar 71a or 71b, and as the pocket 42 is moved past the stationary trigger arm 79b, trigger finger 74b is rotated along with gripper hook axle 73 and gripper hook 72b. The over-center spring mechanism 60 assists in completing the movement of the gripper hooks 72b from the unclamped to the clamped position.

As the gripper hooks 72b are moved into the clamped position (FIG. 7), the extended flap of the newspaper jacket is pushed away from the pivotal side 51 by the gripper hooks 72b, and the shorter flap of the newspaper jacket is clamped by gripper hooks 72b against the planar sheet 51a.

After the short side of the jacket has been clamped, the pocket passes over a raised cam bar 71a or 71b which causes the pivotal side 51 to move up into a closed position, very near and parallel to the fixed side 50. A second retractable trigger arm 79a, mounted on frame 43, identical to trigger arm 79b but at a higher elevation, engages the trigger finger 74a associated with the fixed side gripper hooks 72a and rotates the gripper hooks 72a to the clamped position over the extended flap of the newspaper jacket to hold the extended flap against the planar sheet 51*a*.

After both sides of the jacket have been gripped, the cam follower 70 drops off the cam bar 71*a* or 71*b* causing the pivotal side 51 to pivot downwardly, opening the pocket. The jacket at this point is in a rearwardly open position relative to the movement of the assembly conveyor 23, and the jacket is ready for receipt of an insert.

After receipt of an insert, as will be described later, the pocket 42, now holding a completed product, is moved over cam bar 71*c*, which causes pivotal side 51 to pivot upwardly thereby again closing the pocket. Another set of stationary trigger arms 80*a* and 80*b* (FIG. 2), identical to the trigger arms 79*a* and 79*b* except that they are positioned at slightly different elevation, engage the other "L" extension of the trigger fingers 74*a* and 74*b* from the "L" that was engaged to clamp the jackets. The gripper axles 73 are rotated to move the gripper hooks from the clamped to the unclamped positions. After the jacket is unclamped, the pocket passes over the end of the support rods 59 allowing the completed product to fall under the force of gravity onto the discharge drum 61 and thereby be fed onto the discharge conveyor 24, as seen in FIG. 18.

It will be noted that by raising the pivotal side 51 to a very nearly vertical position, virtually parallel to the fixed side 50, very little friction between the jacket and the sides 50 and 51 is encountered, as has been experienced in prior art pockets of this type. It is also noted that the first pair of trigger arms 79*a* and 79*b* must be laterally moveable or retractable to coordinate the jacket opening procedure for either in-line or off-line operation of the newspaper inserter 20.

During the process of opening the newspaper jacket, it is necessary that the newspaper jacket be supported on support rods 59 and be dimensioned so that the gripper hooks 72*a* and 72*b* can clamp respectively the extended half of the jacket and the shorter half of the jacket. Because there is as much as a three inch variation in cut-offs for newspaper jackets, the height of the short half and extended half of the jacket can vary. If the variance is enough, the gripper hooks 72*a* and 72*b* will either foul because the newspaper jacket is too long or be unable to clamp either the short or the extended half because they are too short.

Figure 19:
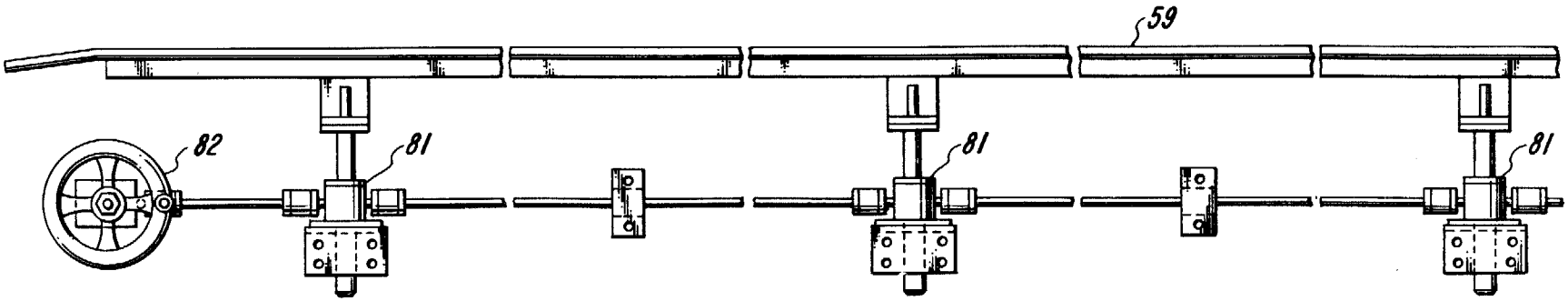
FIG. 19 is a partial diagrammatic side elevation of the adjustable support bars and jacks of the newspaper inserter.

The support bars 59 are therefore mounted to screw jacks 81, as seen in FIG. 19 so that they can be raised or lowered to accommodate the dimensions of various newspaper jackets. A simple hand crank 82 can interconnect all the screw jacks 81 so that upon turning the hand crank 82 both support rods 59 are raised or lowered.

A latching mechanism 83, (FIG. 6) suspended from the bottom of the pocket 42, is activated in the situation where although a jacket has been fed, for one reason or another, there has been a failure of the insert feeder 22 and an insert has not been fed. In order to avoid confusing newspaper jackets with inserts and newspaper jacket without inserts, it is therefore preferable to remove the jackets that do not have enclosed inserts via the reject chute 28.

Figure 8:
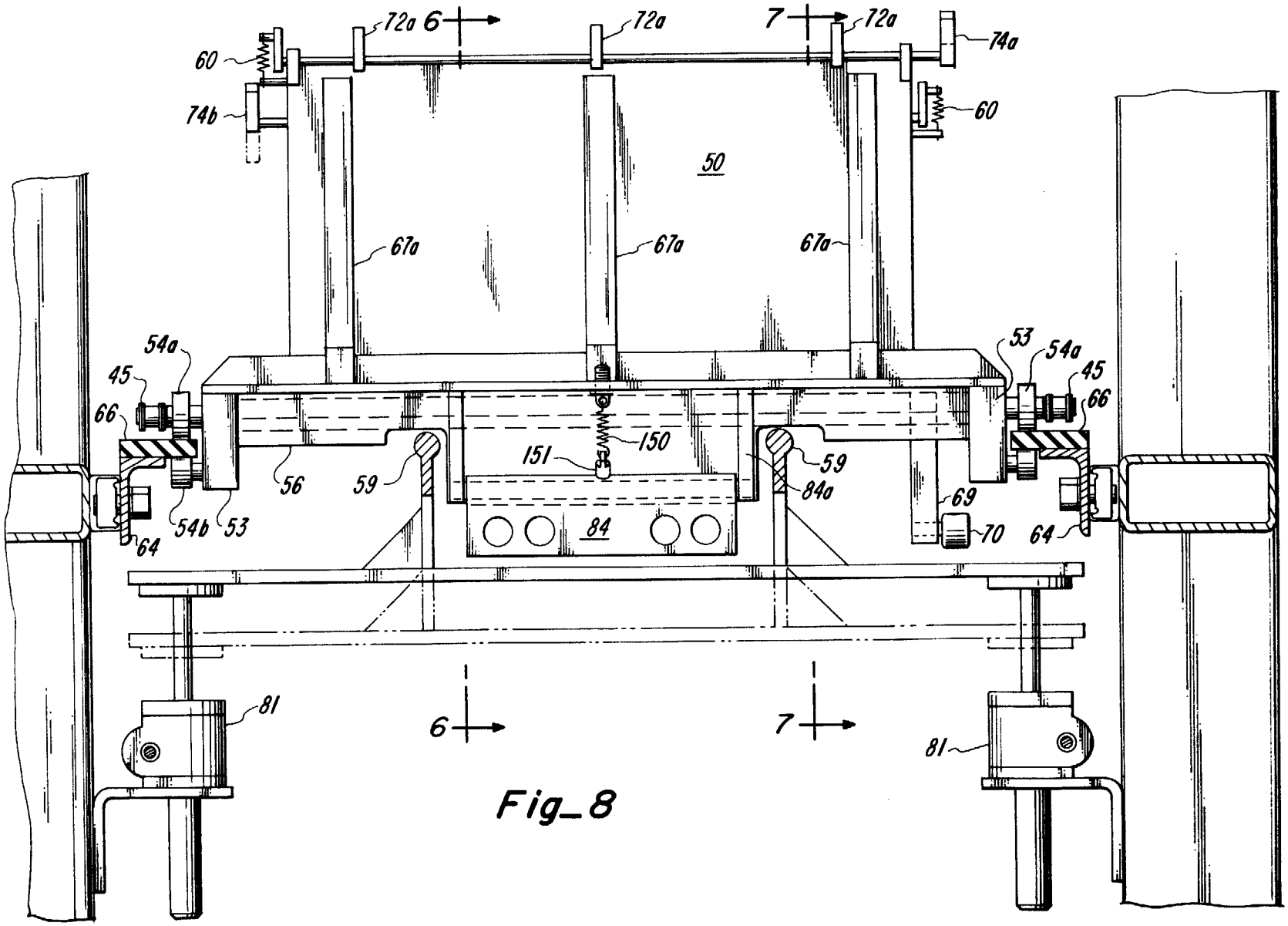
FIG. 8 is a vertical section of the pivotal side of the pocket of the newspaper inserter.

The latching mechanism 83 includes a plate 84 pivotally connected between mounting bars 84*a* mounted on the fixed side 50, along an axis transverse to the path of movement of the pockets 42 (FIGS. 6 and 8). A spring 150 is bolted at one end to the T-cross sectional bar 56 of the fixed side 50. The other end of spring 150 connects to an ear 151 at the pivotal connection between the plate 84 and the mounting bar to thereby bias the plate toward an open or hanging position, wherein a jacket between the pivotal and fixed sides 51 and 50 would drop if not otherwise supported.

A latch 86 is pivotally suspended, generally below the rectangular cross sectional bar 58 spanning the end portions 53 of pocket 42, on a mounting 152. A spring 153 biases latch 86 toward the plate 84 at one end of the spring, the other end of the spring being connected to rectangular cross sectional bar 58. The latch itself is relatively narrow in comparison to the width of the plate 84.

The latch 86 is adapted to receive and releasably retain the bottommost edge of the plate 84 when the plate is positioned horizontally, as shown in phantom lines in FIG. 6. The plate in this position bridges the open space between the pivotal side 51 and the fixed side 50, closing the opening through which a jacket would otherwise fall.

In actual operation, once it has sensed that an insert has not been fed, a high speed air cylinder 88 (FIGS. 2 and 6) extends into the path of the plate 84, but to one side or the other of latch 86. The plate is pivoted to engage the latch 86, prior to the pocket 42 reaching the discharge conveyor 24. After the pocket 42 carrying the jacket without an insert passes the discharge conveyor, a second air cylinder 89 extends to a position where it can engage the bottommost extension of the latch 86. The latch is pivoted to the position shown in phantom line in FIG. 6 and the plate 84 returns to a generally vertical position under the influence of spring 150. The jacket without an insert then drops into the reject chute 28 for further handling.

Insert Feeder Structure and Operation

The insert feeder 22 of the present invention is an important element in achieving the high insertion speeds necessary to make the newspaper inserter 20 compatible with presses producing upwards of 40,000 issues per hour. The insert feeder 22 of the present invention does not rely to any great extent on high speeds to feed the inserts. Rather, an increased proportion of the cycle time of the insert feeder 22 of the present invention is utilized in driving an insert, meaning that proportionally less rotational speed in the insert feeder 22 is required.

The insert feeder 22 continuously receives prestacked inserts from a hopper feeder 92. Once stacked within the insert feeder, the inserts are gripped along the folded edge, which is the downstream or front edge, and moved downward a preselected distance. The folded edge of the insert is then directed downward where the folded edge is nipped and the insert pulled out of the insert feeder in a manner to be described hereinafter. The insert is driven past a guide 146 and down into an open pocket 42 containing a jacket.

The insert feeder 22 (FIGS. 9 and 10) has a pair of opposed flat plates forming a feeder frame 90 mounted to the inserter frame 43 at a position above the path of travel of pockets 42. The feeder frame 90 is adapted to support the various pivot shafts and cam shafts which support the various components that handle and move any given insert. The feeder frame 90 also provides support for a hopper 91 in the form of a rectangular bin which is adapted to receive stacked inserts as they are periodically dropped in stacked form from a hopper feeder 92. The hopper is open at the bottom so that the lowermost insert of a stack can be removed from the front or downstream end.

Figure 20:
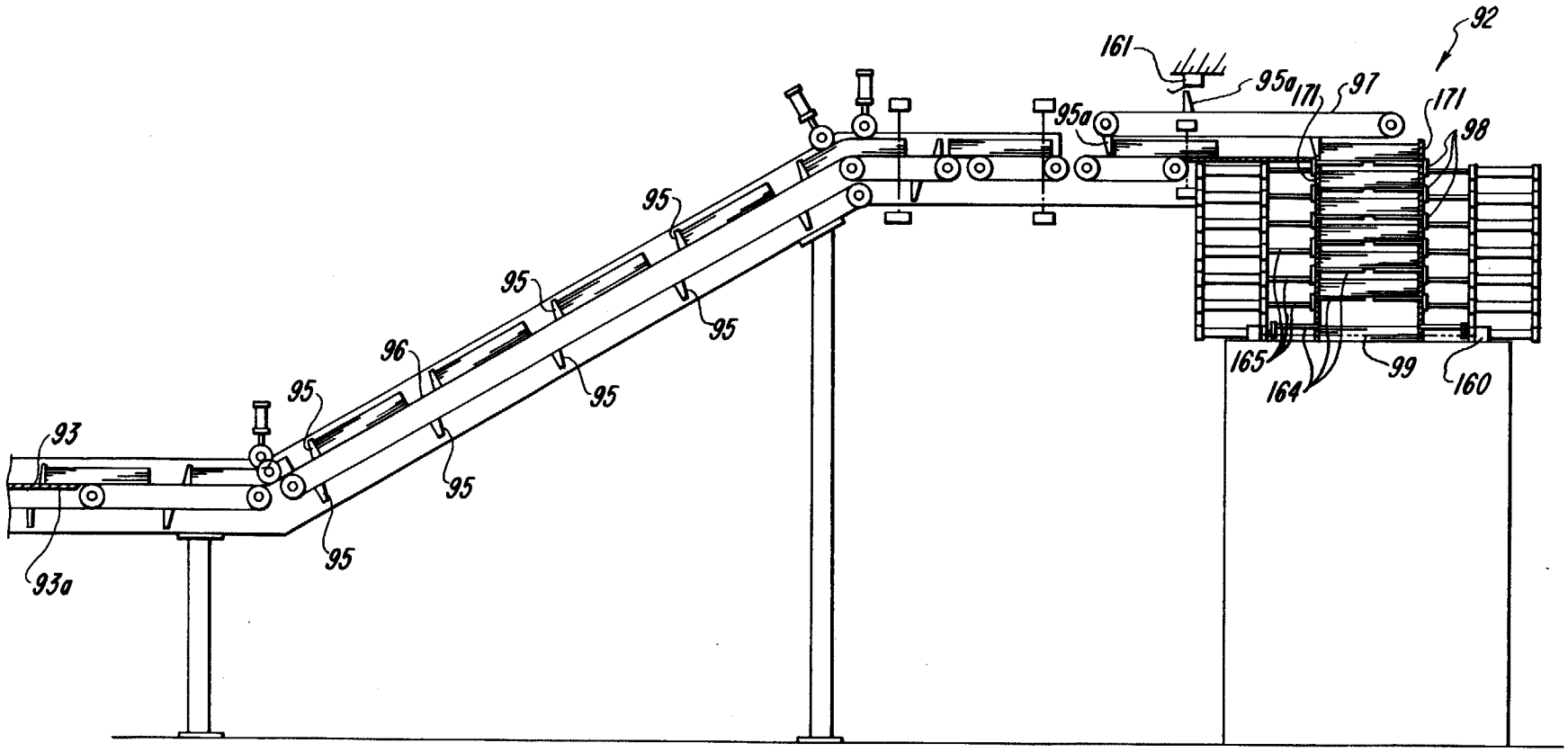
FIG. 20 is a diagrammatic side elevation of the insert stack feed conveyor.

The hopper feeder 92 feeds stacked inserts from an assembly table 93, as seen in FIG. 20. It has been found that with the insert feeder of the present invention, stacks of inserts within a range of 2½ to 3 inches thick work the best. The dropping of thicker insert stacks into the hopper 91 transmits gravitational forces onto the inserts at the bottom of the stack in the hopper of sufficient magnitude to create misfeeds through the insert feeder as more than one insert is put in a position to be fed through the insert feeder 22 as will be more apparent with the following description. Thicker insert stacks also increase friction between adjacent inserts at the bottom of the hopper 91, making it more difficult to separate individual inserts from a stack.

There are mounted to the forwardmost or downstream end of the hopper 91, a plurality of pneumatically operated front end supports 94 (FIG. 9) which act in unison to extend and withdraw in support of the downstream end of the stack of inserts held in the hopper 91, allowing the lowermost insert to be pulled from the hopper through the opening in the downstream end. The front end supports 94 work in conjunction with the insert feeder cycle to be discussed shortly.

Figure 21:
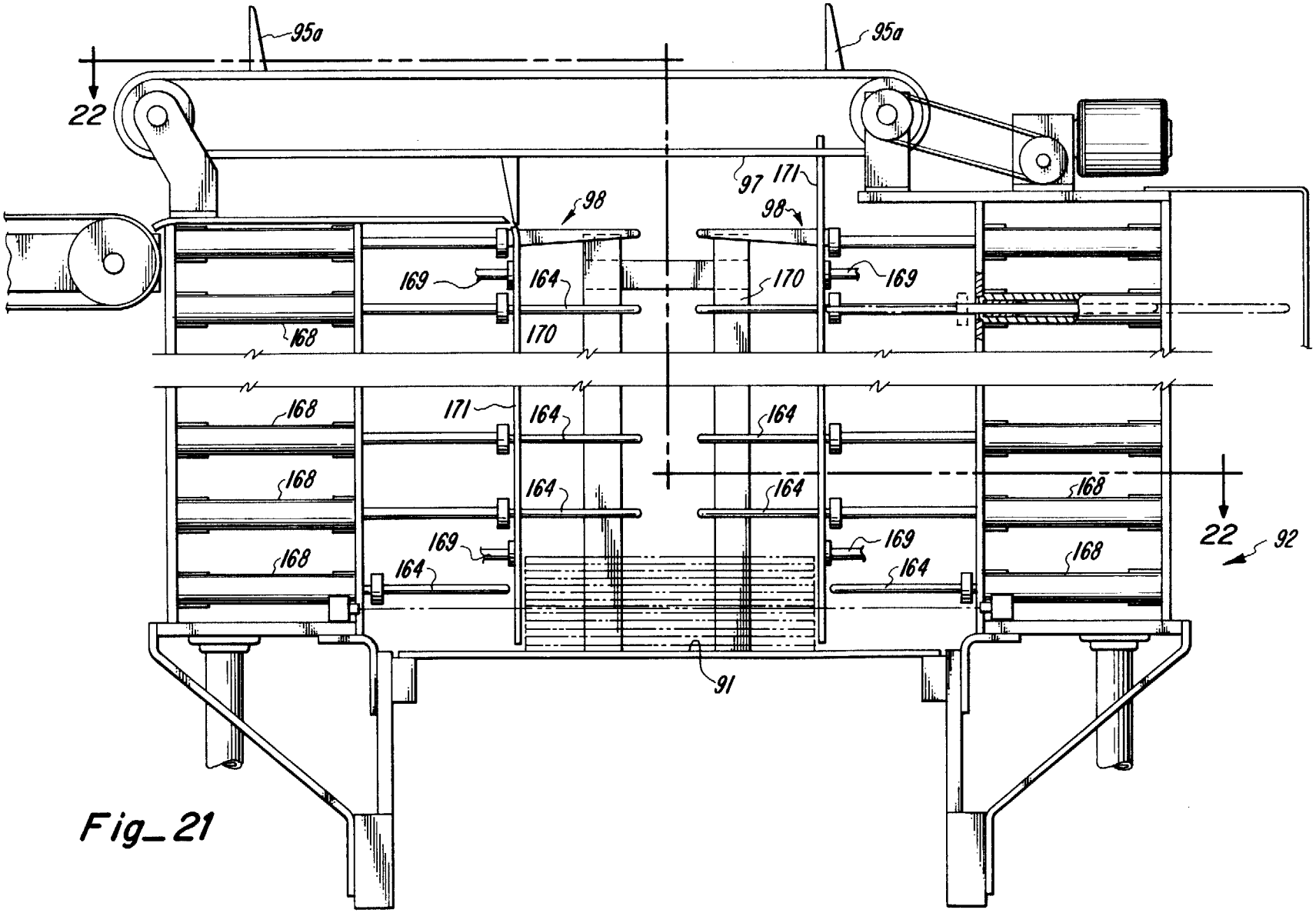
FIG. 21 is an enlarged section view of the support surface of the hopper feeder of FIG. 20.
Figure 22:
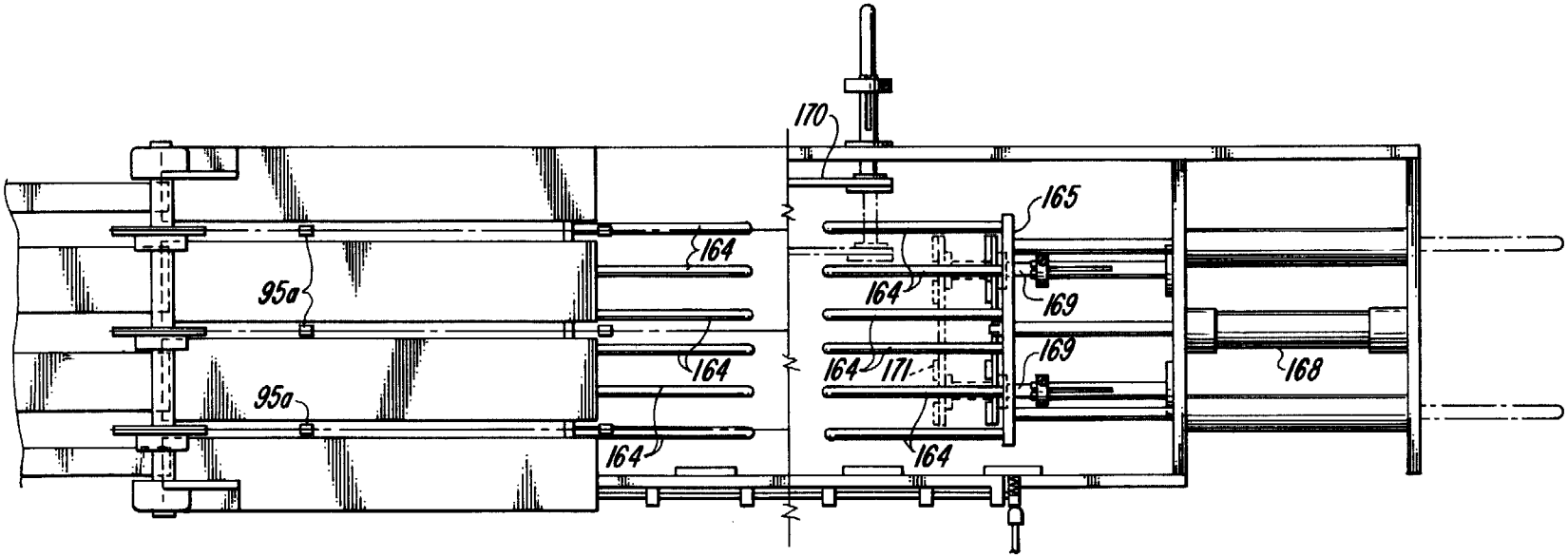
FIG. 22 is a section view taken along line 22—22 of FIG. 21.

The hopper feeder 92, best seen in FIGS. 21 and 22, receives stacks of inserts from a feed table 83, where the stacks are manually fed onto a slotted stationary table surface 93*a* between perpendicularly oriented pushers 95 located at spaced locations along its length. The pushers make contact with the stationary insert stack to push it onto the belt conveyor 96 which is traveling at the same speed as the pusher. The pushers 95 keep the stacks straight and in spaced, longitudinal alignment as they are raised by the belt conveyor 96 to a position above the newspaper inserter 20 and the hopper 91. If there are many thin inserts in a stack then the belt conveyor 96 can travel at a relatively slow speed. If there are few thick inserts in a stack then the belt conveyor 96 must travel at the higher speed in order to match the requirements of the insert feeder 22. An indexing conveyor 97 receives stacks from the conveyor 96 and moves the stacks, one at a time, as they reach the upper end of the conveyor 96 onto a plurality of vertically stacked insert support surfaces 98. The indexing conveyor 97 is positioned adjacent and slightly above the belt conveyor 96, and above the insert trays 98 and the hopper 91.

The support surfaces 98 (FIGS. 21 and 22) include two facing elongated portions 164, each of which are rigidly connected to an arm 165 and extend through guide plate 171. The arms are extended and withdrawn by opposed cylinder-pistons 168, seen in dotted line in their withdrawn position in FIG. 21. Adjustable guide plates 170 (FIG. 22) move in and out along a line perpendicular to the indexing conveyor 97 so that the stacks are dropped in proper alignment. Similar guide plates 171 align the stacks in the direction parallel to indexing conveyor 97. The adjustable feature allows for various sized newspaper inserts. The pistons 168 are air operated upon receipt of a control signal generated by a sensor 160. The sensor 160 detects the drop of the bottommost stack into the hopper.

The hopper 91 has provision for sensing the level of the insert stacks in the hopper 91, which can be of the type disclosed in U.S. Pat. No. 4,046,370 to Navi. Sensors 160 determine the passage of an insert stack to the hopper 91 from the sequentially retractable trays 98. The bottom set of support surface 98 will usually be retracted because the insert stack on the hopper 91 will start out above the level of the bottom support surface 98. When the stack drops below the level of the sensor 160, the bottom support surface 98 will extend and at the same time the next top support surface 98 will retract to drop its insert stack on the extending support surface to break the fall of the insert stack. The bottom support surface then immediately retracts again to drop the insert stack onto the insert stack on the hopper 91. The upper supporting surfaces then sequentially extend to drop their stacks on the next lower supporting surface.

The indexing conveyor 97 has its own pushers 95*a* to advance the stacks onto the top tray 98. It also activates a limit switch 161, which is positioned so as to advance the stack in the proper position on the tray 98 depending upon the size of the insert stacks. The indexing conveyor remains in position until the stack is dropped onto the next lower tray at which time the index conveyor pushes the next awaiting stack into position in top tray 98.

In an alternative embodiment, not shown, the arms 164 and insert trays 98 could be alternately angled up and down, rather than horizontally, so that as the inserts are dropped they are fanned. Some manual manipulation has been required of inserts in order to break them loose from each other, since sticking between inserts often occurs as the ink dries while the insert is being stored. With this embodiment, any insert stuck to an adjacent insert would be broken away mechanically during the fanning action.

The hopper feeder 92 thereby continuously supplies the hopper 91 with stacks of inserts. This allows the insert feeder 22 to automatically feed inserts with little human intervention, except to feed the insert stacks onto the conveyor table.

Figure 9:
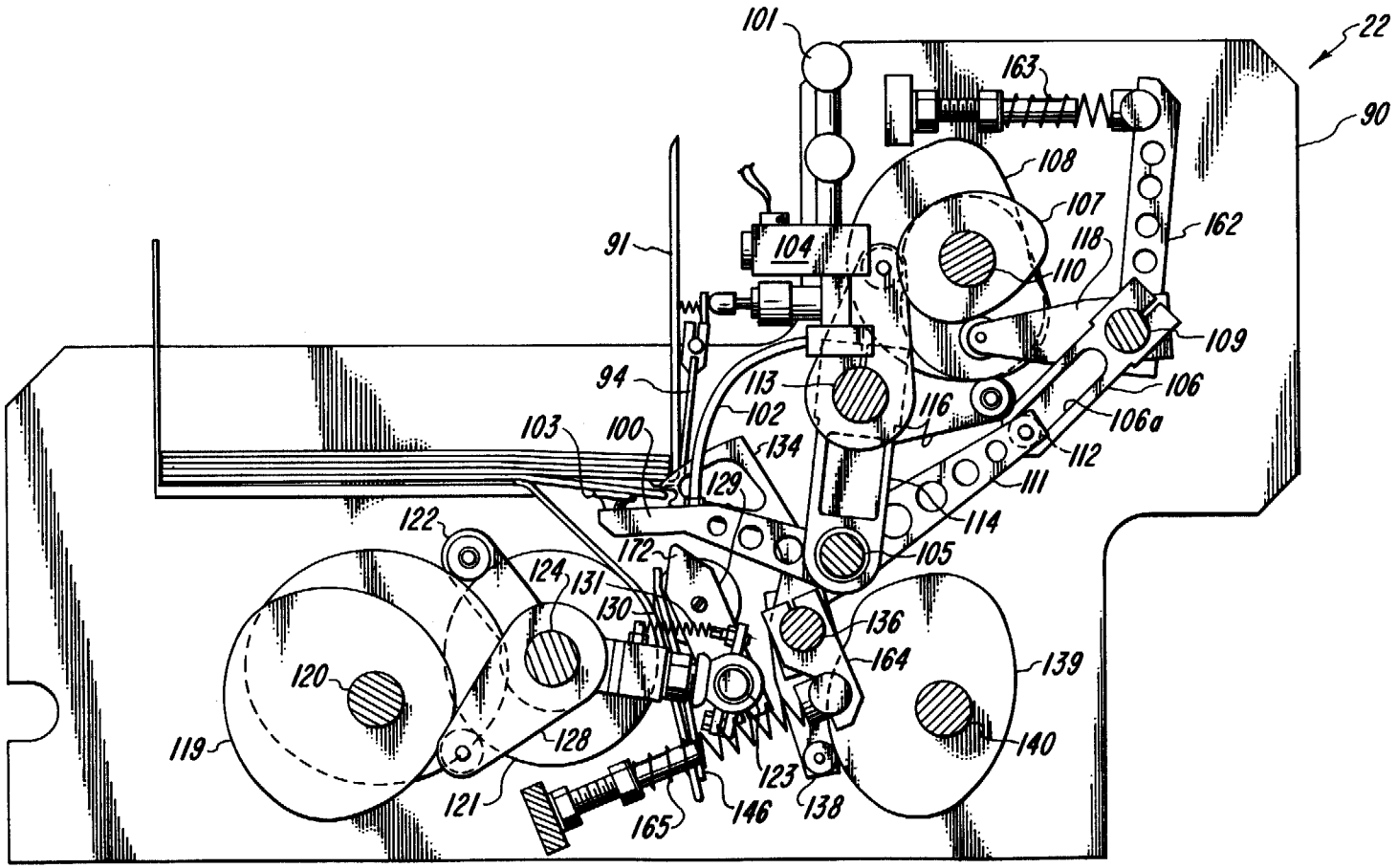
FIG. 9 is a sectional view taken along line 9—9 of FIG. 10.

In the preferred embodiment of the insert feeder 22 four separate sucker arms 100 are disposed transversely across the front or downstream end of the hopper 91. The hopper 91 receives the inserts from the hopper feeder 92 so that the folded portion of the insert is to the front, immediately above the sucker arms 100 and disposed in the opening in the bottom of the hopper. Each sucker arm 100 is connected to vacuum supply 101 through flexible latex tubing 102 or the like as seen in FIG. 9. Each sucker arm 100 has a cup 103 which actually contacts the underside of an insert and applies the suction to the insert through internal conduits in the sucker arms, not shown, between the tubing 102 and the cup 103. High-speed solenoid valves 104, one for each sucker arm, synchronously admit the vacuum to the sucker arms 100 through the tubing 102 as needed and as will become more clear with the description that follows.

Relative to the hopper 91 holding the stack of inserts, the sucker arm 100 pivots downward from the hopper 91 and translates along a line away from the hopper 91, corresponding to the downstream movement of the pockets 42 which are moving underneath the insert feeder 22. This motion permits the sucker arms 100 to clear the portion of the insert feeder 22 to allow the pushers 134 to push the inserts downward into the driving roller, and while the inserts are being driven the sucker arms 100 can move back to a position just below the next insert to be fed from the hopper 91. Even though the pivot of the sucker arm 100 is opposite to the pivot point about which the insert moves, the movement of the sucker arm 100 from its initial contact with an insert to the point at which it releases the insert is only a very small arc, in the neighborhood of 6°. This small angle means that even though the insert and the sucker arm are pivoting from opposite pivot points, the arcs do intersect and make for a workable operation.

To obtain the motion required for the sucker arms 100, the sucker arms are rigidly joined at the end opposite the suction cup to a connecting rod 105 for unitary pivotal movement with the rod. The motion of the connecting rod 105 is governed by a longitudinally grooved plate cam 106 and a sucker arm conjugate cam 108. The plate cam 106 is fixed to a plate cam pivot shaft 109 rotatably mounted across the feeder frame 90. The sucker arm conjugate cam 108 is mounted to a conjugate cam shaft 110, which is also rotatably mounted between the sides of the frame 90. Conjugate cam 108 has two separate cam surfaces that are out of phase with each other for reasons to be discussed shortly.

The plate cam 106 is moved through a preselected pivotal movement about pivot shaft 109. A cam lever 118 is rigidly connected at one end to the plate cam pivot shaft 109 while the other end of the cam lever 118 engages and follows the defined path of cam 107 mounted on conjugate cam shaft 110 and adjacent to conjugate cam 108. The cam lever 118 is forced to contact the surface of arm 107 of spring 163 mounted to the frame 90 acting on spring arm 162 mounted on pivot cam shaft 109.

The plate cam 106 controls the up and down or pivoting movement of the sucker arms 100 by pivoting the connecting rod 105 through a second cam lever 111 fixed to the connecting rod 105. The cam lever 111 has a cam roller 112 that travels within a longitudinal groove **106*a* of the plate cam 106, as best seen in FIG. 9**.

The in and out movement of the sucker arms 100 is governed by a pivot shaft 113 connected to the connecting rod 105, which connects to the sucker arms 100, through a pair of connectors 114 spaced along the length of shaft 113. The pivot shaft 113 is rigidly connected to a pair of cam levers 116 which follow the rotation of the two surfaces of sucker arm conjugate cam 108, which controls the pivot movement of the pivot shaft 113 and connected sucker arms. The two surfaces of conjugate cam 108 work to hold both levers 116 in contact with the respective surface at all times. The sucker arm conjugate cam 108 controls the in and out and dwelling positions of the sucker arm assembly. Cam levers 116 therefore follow the out of phase path defined by the conjugate cam surfaces 108 and each serve to hold the other in contact with the surface.

The rotation of the sucker arm conjugate cam 108 therefore causes the translational movement of the connecting rod 105 by pivot shaft 113 through cam levers 116 respectively. Connecting rod 105 is rotated by the plate cam 106 which follows cam 107, thereby pivoting the connecting rod 105 and the attached sucker arms 100. Pivoting connecting rod 105 draws down the bottom insert while pivot shaft 113 dwells. After releasing the insert pivot shaft 113 pivots to move the suction cup arms out of the way. On the return motion both pivot shafts 113 and 109 pivot in the opposite direction to place the suction cups under the next bottom insert.

A second conjugate cam 119 having two surfaces is mounted on a driven shaft 120 at a position again below the hopper 91, but slightly upstream or toward the back of the hopper 91 and near the opposite side of the frame from conjugate cam 108. A main drive roller 121 runs horizontally underneath the hopper 91 at a position slightly forward of the driven shaft 120 relative to the hopper 91. The main drive roller 121 is wider than the hopper and the insert stacks. The main drive roller 121 is fixed at a position slightly to the rear of the hopper 91 as compared to the position of the sucker arms 100 as they pivot downwardly and the roller is rotatable about cam pivot shaft 124. A dog-leg cam lever 122 has a follower **122*a* at one end adapted to follow one cam surface of the second conjugate cam 119. The dog-leg cam lever is rigidly connected at an intermediate location to the pivot shaft 124, and has an idler shaft 123 journalled in an end 126 opposite the follower 122*a*. A cam lever 128 is also rigidly connected to the pivot shaft 124 and follows the other surface of conjugate cam 119. The fact that both the dog-leg cam lever 122 and the cam lever 128 follow the respective surfaces of conjugate cam 119, and are rigidly connected to drive roller pivot shaft 124, makes for a more positive engagement between the surface of the conjugate cam 119 and the dog-leg cam lever 122 and cam lever 128 than would be available from merely spring biasing the dog-leg cam against a plate cam. This same principle applies to the sucker arm conjugate cam 108, which is followed, on separate surfaces, by cam levers 116**.

The idler shaft 123 has fixedly mounted along its length four pivotal levers 172 (FIGS. 9, 10 and 11), each of which is formed by a pair of forks 129 extending upwardly from the idler shaft 123 toward the hopper 91. Between each pair of forks 129 is rotatably positioned on idler roller 130, as best seen in FIG. 11. A tension spring 131 is connected between the dog-leg cam 122 and a tension arm 132 which is rigidly connected to the idler shaft 123. A bushing 133 allows the shaft 123 to pivot relative to the dog-leg cam 122. As a result of the tension spring 131 interconnecting the rotatable idler shaft 123 with the dog-leg cam 122, the pivotal levers 172, which are rigidly connected to the idler shaft 123, and their retained idler rollers 130 are spring biased against the main drive roller 121. The fact that the idler rollers 130 are spring biased against the main drive roller 121 means that various thickness of inserts can be fed between the driven roller 121 and the idler rollers 130 without manual adjustment of the space between the rollers.

Five push levers 134 (FIGS. 9 and 10) are rigidly connected to a pivot shaft 136 which is journalled at each end in the two spaced frame members 90. The push levers 134 are at generally the same position as the sucker arms 100 and interleve the sucker arms. The unique shape of the push levers is such that an upper arctuate portion (FIG. 9) is always beneath the front end of the hopper 91. This assists in the support of the inserts while the front end supports 94 are withdrawn. A cam lever 138 is also rigidly connected to pivot shaft 136 near the end thereof adjacent conjugate cam 119. The cam lever 138 is conventionally biased by a compression spring 165 and a spring arm 164 mounted on shaft 136 to follow a cam 139 mounted upon a cam shaft 140, which also is journalled at both ends in frame members 90. The push levers 134 move downward as lever 138 pivots shaft 136 while the lever follows cam 139. As an insert is drawn downward by the sucker arms 100 the push levers move down to force the front edge of the insert between the main driven roller 121 and the idler roller 130 at a preselected time after the suction cup arms have been withdrawn from the downstream travel of the insert. This motion is best illustrated in FIGS. 12 through 16.

The drive arrangement for the insert feeder 22 derives initially from the drive motor 47b turning drive shaft 46, as seen in FIG. 2 and as discussed previously. A right angle gear box 141 (FIGS. 2) takes the rotation of the drive shaft 46 to turn a timing belt sprocket on a shaft mounted across the front of insert feeder frame 90. A second timing belt sprocket (not shown) drives cam shaft 110. A third timing belt drive and sprocket (not shown) interconnects cam shafts 110, 120 and 140. All are driven at the same speed and the cam shafts timed such that cam pivot shafts 109, 113, 124 and 136 are all actuated in the proper sequence for the movements of the sucker arms 100, idler rollers 130 and push levers 134. One revolution of the three cam shafts represents one complete insert feed cycle period.

Figure 10:
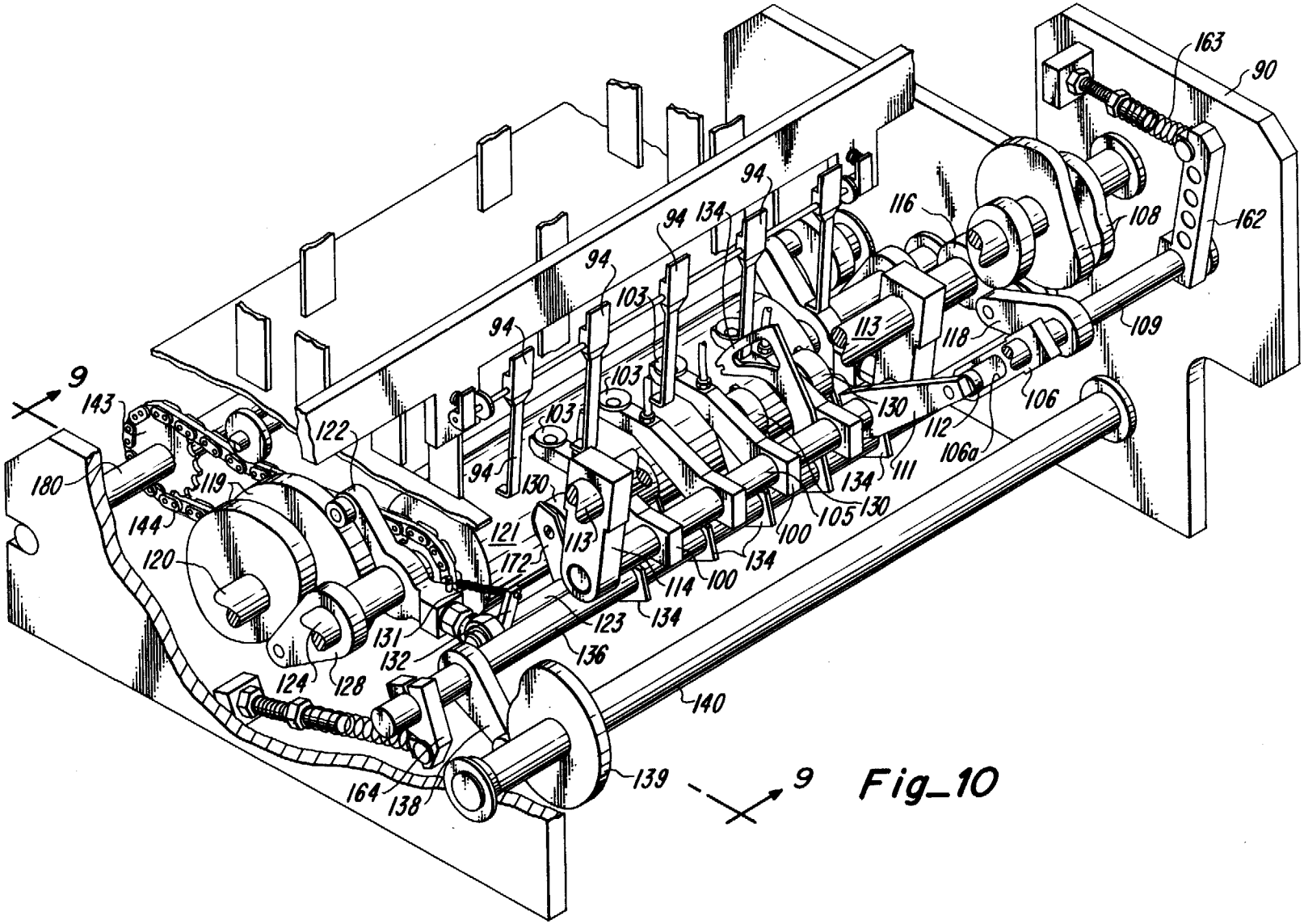
FIG. 10 is a fragmentary perspective view of the insert feeder with parts broken away for clarity.
Figure 11:
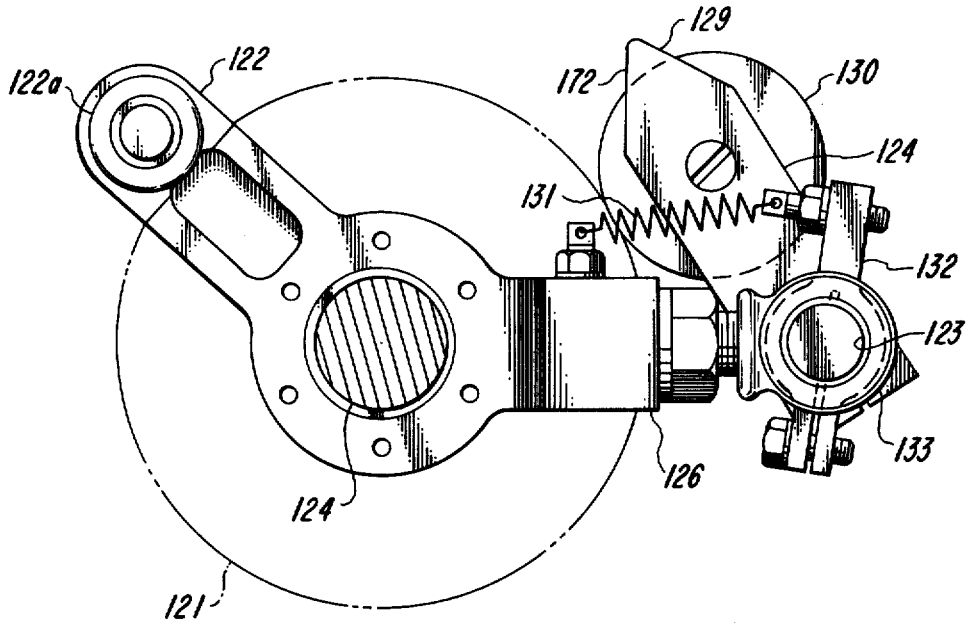
FIG. 11 is an enlarged vertical section of the drive roller and idler roller of the insert feeder.

Another timing belt drive from cam shaft 120 to shaft 180 drives sprocket 143 which has a roller chain 144 connected to a sprocket mounted to drive roller 121 to drive that roller at the desired speed, as seen in FIG. 10. The main drive roller 121 rotates freely with respect to pivot shaft 124 on bearings, not shown, which permit independent movement of drive roller 121 relative to cam pivot shaft 124.

The operation of the insert feeder 22 requires a continuously repeated timed relationship or cycle between the movements of the sucker arms 100, the idler rollers 130, push levers 134 and front end supports 94, as shown in FIGS. 12 through 16.

Figure 12:
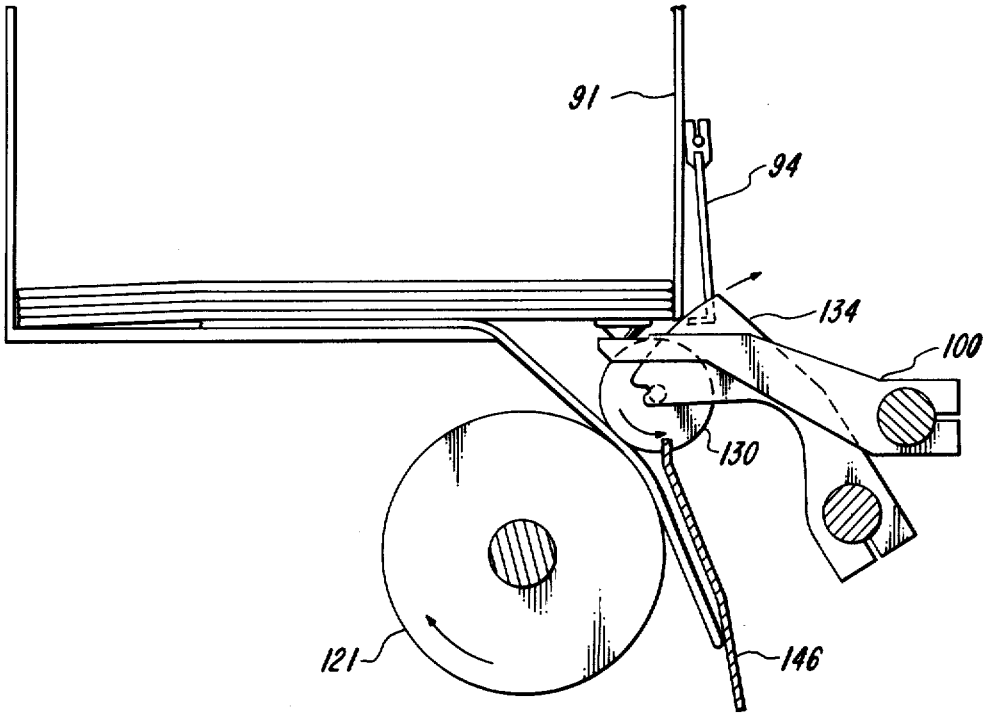
FIGS. 12 through 16 are operational views of the insert feeder, sequentially showing the movements of the insert feeder in feeding an insert.

FIG. 12 illustrates the position in the cycle wherein contact by the cups 103 of the sucker arms 100 is made with the front edge of the lowermost insert in a stack. The cup 103 of the sucker arm 100 makes contact with the front edge of an insert and dwells while vacuum is being pulled, and as the push lever is returning to a position clear of an insert being fed and the idler roller 130 is at its position nearest the bottom insert and starting to move down. The front end support 94 is retracted into a non-supporting position.

Figure 13:
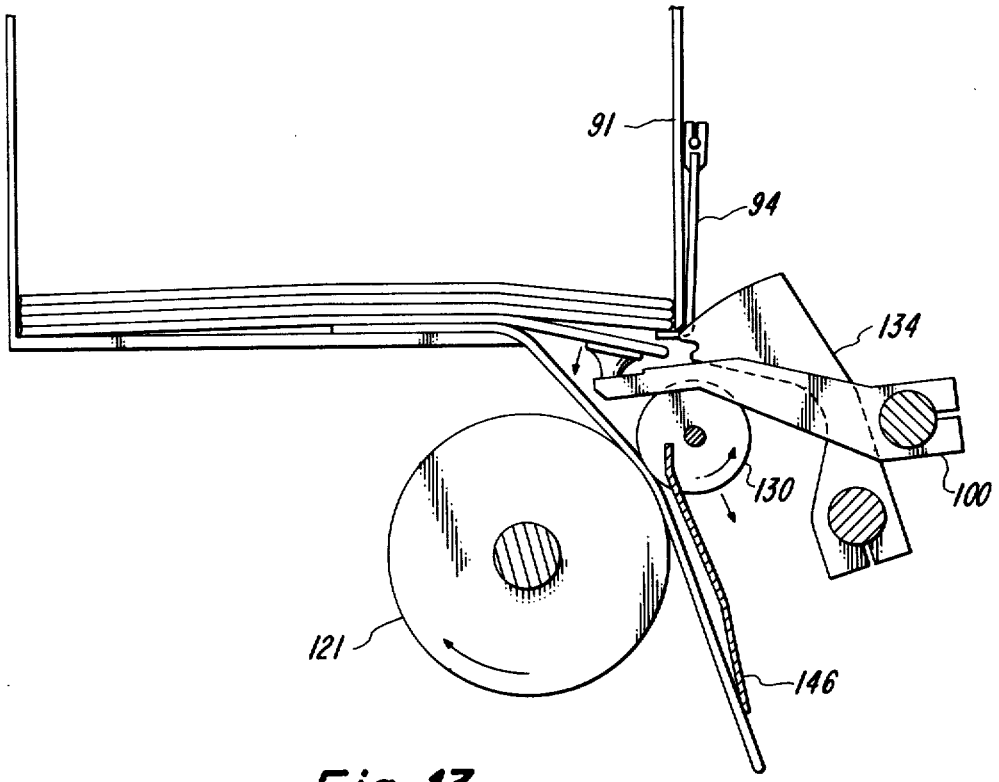

In FIG. 13, the sucker arms 100, and their cups 103 which have a vacuum grip on the front edge of the insert to be fed, descend under the influence of the longitudinally grooved plate cam 106. The push levers 134 are at their uppermost position. The idler roller 130 still driving the previously fed insert, moves down to clear the area below the hooper 91 as dog-leg cam lever 122 follows conjugate cam 119. Front support fingers 94 move back under the insert stack.

Figure 14:
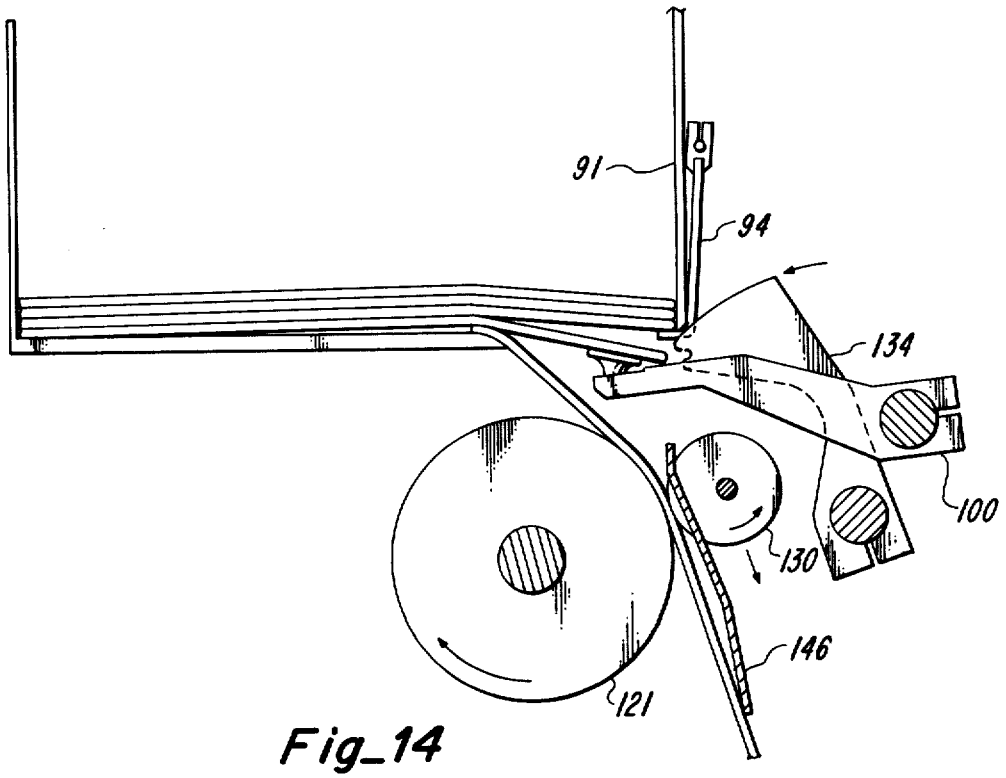

In FIG. 14, the sucker arms 100 have descended to their lowest position relative to the hopper 91 and dwell momentarily to release the vacuum. The push levers 134 are moving downward to a position where they are about to engage the front edge of the insert to be fed.

Figure 15:
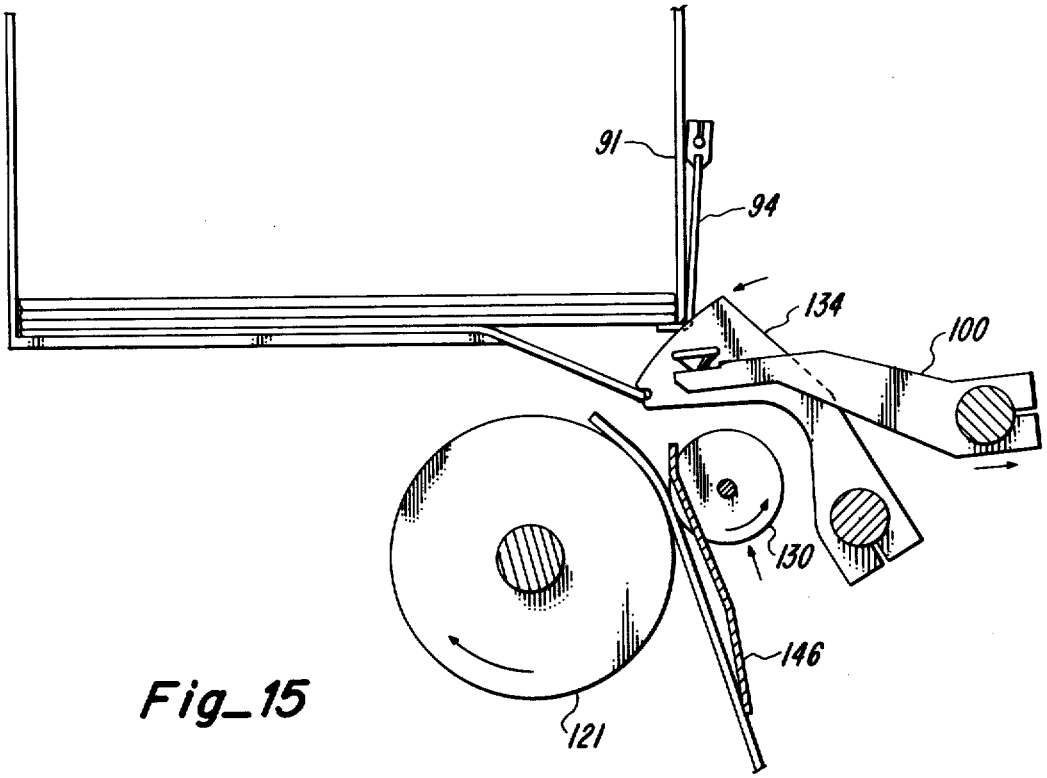

Referring next to FIG. 15, the sucker arms 100, the cups 103 no longer engaging the insert, are withdrawn from a position underneath the hopper 91 and are moving away from the hopper 91 under the influence of the sucker arm conjugate cam 108, leaving a path clear for the insert to be driven by the push levers to the driven roller waiting to be nipped by the idler roller. The preceding insert has almost passed through the rollers, and the idler roller 130 is beginning to move back to a raised nipping position.

Figure 16:
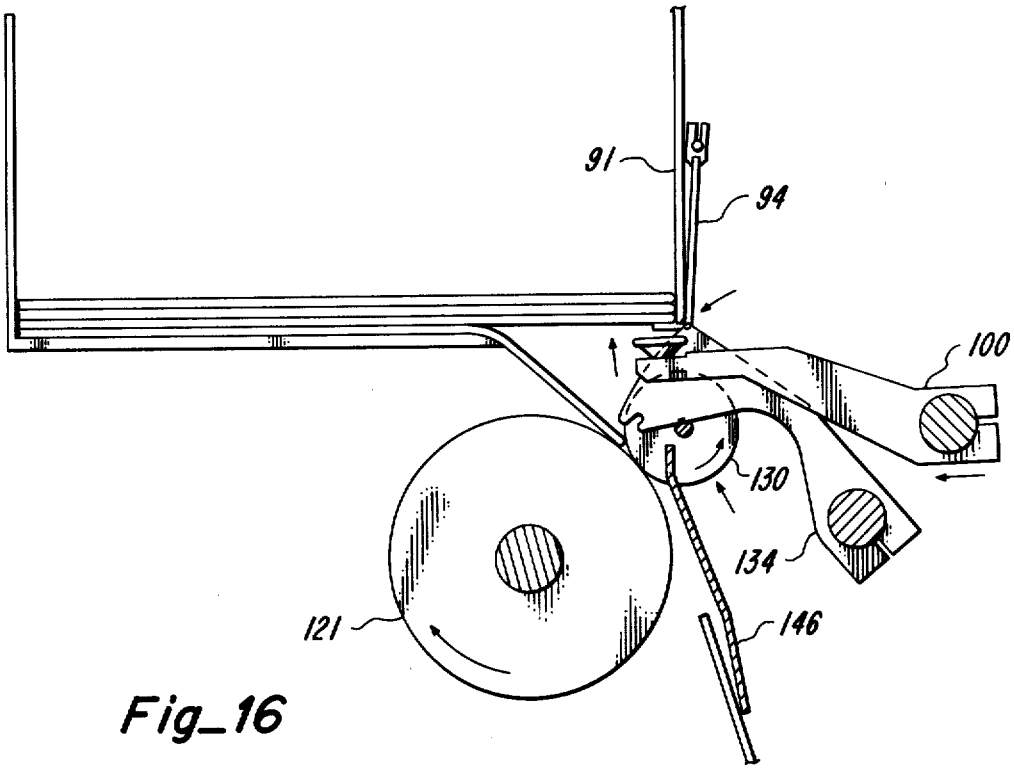

In FIG. 16, the idler roller 130 has moved upward relative to the main drive roller 121 under the influence of the second conjugate cam 119. In this position the driven roller 121 and idler roller 130 can nip the front edge of the insert being driven downwardly by the push levers 134 and pull the insert out of the hopper 91. Simultaneously with this operation, the sucker arms 100 are moving back toward the hopper 91 to a position where the next insert can be gripped. The push levers are beginning to move upward toward its drop position. The aforedescribed cycle is continuously repeated for as long as there are inserts to be fed.

Missed Jacket and Insert Sensing

Provision is made for sensing the failure of the feed conveyor 35 to deliver a jacket into a pocket 42, or of the insert feeder 22 to deliver an insert to a jacket in a pocket 42 so that incomplete products are not delivered to the discharge conveyor 24. Missed jacket sensing occurs at the feed conveyor 35 (FIG. 2). Photoelectric sensor 166 is tripped by a jacket feed. Failure to feed a jacket causes a signal to enter a control circuit (not shown). A first photoelectric sensor 148 locates a pocket 42 having a light reflector 149 mounted to the outside of the fixed side (FIG. 6). Signals are fed from sensor 148 into the first of two side by side solid state shift registers 147 (FIG. 2). The registers shift as the pockets 42 move down the line. Each register 147 has as many shift positions as there are pocket positions from the beginning sensing point, underneath the feed conveyor 35 to the end of the run, beyond the reject chute 28. The first shift register 147 is used to control the operation of the insert feeders 22, cutting off the feeding of the insert into the pocket 42 which has been sensed to have no jacket. The second shift register controls air cylinders 88 and 89, upon failure to feed an insert into a pocket containing a jacket.

The sensing of the failure to insert a jacket into a pocket 42 occurs through a photoelectric sensor 166, which signals the failure to break the photoelectric beam to a control circuit (not shown). The control signal is sent and stored in one register 147 such that when the pocket reaches the insert feeder 22 position, the control circuit will be gated to keep valve 104 closed, thereby admitting no vacuum to the sucker arms 100. The mechanical movements shown in FIGS. 12 through 16 continue unabated, but no insert is gripped. The inhibiting of outer valve 104 is continued as the register follows the pocket to successive insert feeder 22 positions, if more than one insert feeder 22 is being used.

Failure to deliver an insert into a pocket 42 is sensed by the photoelectric sensor 167, located beneath the insert feeder 22 in the path of delivered inserts. The break of the photoelectric sensor 167 beam indicates a feed has occurred. If a feed does not occur, a signal is sent and stored in the second shift register 147. When the pocket 42 reaches the pocket closure position, high-speed air cylinder 88 is activated by a second control circuit (not shown) to close the latching mechanism 83. The pocket 42 then continues to travel beyond the end of the support rods 59, which support rods normally allow the completed product to drop onto the discharge conveyor 24. The second shift register 147 continues to track pocket 42 as it moves toward the second high-speed air cylinder 89 which is actuated to unlatch the latching mechanism 83. Actuation of the second high-speed air cylinder allows the defective product, absent an insert, to drop down the reject chute 28 from where it is removed to a set position so that an insert can be manually added and the product redistributed.

In the case of a missed jacket feed, where it is desired to skip the feeding of an insert from the insert feeder 22, restraints exist not only within the electrical circuit operation but also in the operation of the high-speed vacuum valves, which must be capable of operating reliably at 1,400 cycles per minute. No mechanical operational change in the insert feeder 22 is required to prevent the feeding of an insert, other than the fact that the air operated front end supports 94 are not withdrawn when no suction is applied to the suction cups 103.

Another advantage of the electrical nature of the front end support 94 and valve 104 release operation is the fact that the on-off periods of each as well as shifting of those periods in relation to the cycle of the insert feeder 22 can be made independently of any mechanical adjustment. This is accomplished by using solid state miniature preset counters (not shown) which receive count pulses from the pulse generator 48 driven by the inserter drive shaft 46 to generate 100 pulses per revolution, which 100 pulses also represent one feed cycle for the insert feeder 22. One preset counter is used to set the pick-up time of the valves (one for each suction cup) and the second preset counter is used to set the drop-out time of the valves. Thus the on-off period can be shortened or lengthened or the entire period can be shifted by changing the count settings of those two counters. A second set of preset counters is used to set the valve to operate the short stroke air cylinder to withdraw the support fingers 94. No critical mechanical adjustments are required such as are needed with cam operated valves. Electrically operating the high-speed valves is more reliable and easier to do than mechanically engaging or disengaging a cam and cam follower operation for the valves.

The preferred embodiment of the present invention has thus been described with a degree of particularity. It should be understood, however, that the specificity of the present disclosure has been made by way of example, and that changes in details of features may be made without departing from the spirit of the invention.

What we claim is:

1. An apparatus for conveying newspaper jackets in lapped orientation from a newspaper press to an assembly conveyor for later insertion of inserts into the newspaper jackets comprising in combination:

newspaper conveyor means for moving said newspaper jackets from the press in a lapped orientation;

means for speeding up said newspaper jackets relative to the speed of said newspaper conveyor means, said means for speeding up said newspaper jackets having an upstream end and a downstream end, said upstream end of said means for speeding up said newspaper jackets being adjacent to said newspaper conveyor means to thereby receive said newspaper jackets from said newspaper conveyor means so as to separate the lapped jackets;

an indexing conveyor having a plurality of pins mounted thereon, said indexing conveyor being adjacent to the downstream end of said means for speeding up said newspaper jackets, said pins adapted to abut a leading edge of said separated newspaper jackets upon receipt from said speed-up means;

sensing means for sensing the position of said newspaper jackets relative to said pins; and means responsive to said sensing means for diverting selected ones of said newspaper jackets away from the indexing conveyor depending upon the position of the newspaper jacket relative to said pins.

2. The invention as defined in claim 1 further including:

receptacle means mounted on said assembly conveyor adapted to receive newspaper jackets fed thereinto;

means for inserting supplemental inserts into said receptacle means;

means for sensing the failure of a newspaper jacket to be fed into said receptacle means;

control means responsive to said means for sensing the failure of a newspaper jacket to be fed; and means for selectively preventing supplemental material from being fed into selected ones of the receptacle means, said means for preventing supplemental inserts from being fed being activated by said control means if a newspaper jacket is not in a selected one of said receptacle means.

3. The invention as defined in claim 2 wherein said means for inserting supplemental inserts into said receptacle means includes vacuum gripping means for sequentially gripping individual inserts, said means for selectively preventing supplemental inserts from being fed into selected ones of said receptacle means further including:

means for preventing said vacuum gripping means from drawing vacuum, whereby no insert is fed into said receptacle means, said means for preventing said vacuum gripping means from drawing vacuum responsive to said control means.

4. The invention as defined in claim 1 wherein said pins are pivotally mounted on said indexing conveyor.

5. The invention as defined in claim 1 wherein said means for sensing the position of said newspaper jackets further include:

first and second photoelectric sensing stations longitudinally spaced along said conveyor so as to be simultaneously aligned with adjacent pins.

6. The invention as defined in claim 5 further including:

control means for receiving a signal from either of said photoelectric sensing stations and transmitting a signal;

a finger mounted transverse to said indexing conveyor and in longitudinal alignment therewith, said finger located immediately downstream from said pins associated with said second photoelectric sensing station, said finger raising in response to the signal transmitted by said control means; and a second finger associated with said means for diverting selected ones of said newspaper jacket whereby said first and second fingers form a ramp up which selected ones of said newspaper jackets are conveyed away from said indexing conveyor.

7. A conveyor system comprising in combination:

a plurality of receptacle means for receiving and conveying vertically oriented newspaper jackets, each receptacle means having an uppermost opening for receiving said jackets and a lowermost opening for discharging said jackets together defining a vertically oriented opening through said receptacle means;

means operatively connected to each of said receptacle means for moving said receptacle means along a predetermined path;

support means positioned a spaced distance below the uppermost opening in each of said receptacle means along said predetermined path, said support means for supporting said newspaper jackets at said spaced distance below said uppermost opening in each of said receptacle means; and means for adjusting the spaced distance of said support means relative to the uppermost opening in each of said receptacle means to accommodate various sized newspaper jackets.

8. The invention as defined in claim 7 wherein said newspaper jacket has an off-fold further including:

means operatively connected to said receptacle means for grasping the off-fold of a newspaper jacket to thereby spread said newspaper jacket open.

9. In a conveyor system having a plurality of moving receptacle means for retaining a newspaper jacket into which an insert is to be fed by an insert feeder, wherein the improvement comprises:

means for sensing the failure to feed insert material into the receptacle means;

a photoelectric beam mounted at a fixed position at a starting position of the conveyor system, a reflector mounted at a fixed position on said receptacle means, said reflector adapted to be sensed by said photoelectric beam, and a shift register adapted to monitor the position of said receptacle based on input signals from said photoelectric beam striking said reflector, whereby said photoelectric beam, said reflector and said shift register define means for tracking the receptacle means from said starting position to a preselected location;

control means responsive to said means for sensing the failure of said insert feeder to feed an insert, said control means further adapted to respond to said means for tracking the position of said receptacle;

means operated by said control means for securing a newspaper jacket in a receptacle if an insert is not fed into the jacket; and means operated by said control means for releasing said newspaper jacket at said preselected location.

* * * * *